US008322084B2

(12) United States Patent
Kestermann

(10) Patent No.: US 8,322,084 B2
(45) Date of Patent: Dec. 4, 2012

(54) MODULAR ROOM AND STRUCTURE

(76) Inventor: Rolf Kestermann, Los Angeles, CA (US)

( * ) Notice: Subject to any disclaimer, the term of this patent is extended or adjusted under 35 U.S.C. 154(b) by 639 days.

(21) Appl. No.: 11/597,830

(22) PCT Filed: Aug. 17, 2005

(86) PCT No.: PCT/US2005/029237

§ 371 (c)(1),
(2), (4) Date: Sep. 6, 2007

(87) PCT Pub. No.: WO2006/023545

PCT Pub. Date: Mar. 2, 2006

(65) Prior Publication Data

US 2007/0294958 A1 Dec. 27, 2007

(30) Foreign Application Priority Data

| | | |
|---|---|---|
| Aug. 19, 2004 | (DE) | 218490-0001 |
| Aug. 19, 2004 | (DE) | 218490-0002 |
| Aug. 19, 2004 | (DE) | 218490-0003 |
| Jan. 28, 2005 | (DE) | 10 2005 003 996 |

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |

(52) U.S. Cl. ..... 52/79.1; 52/79.7; 52/79.9; 52/81.2; 52/234

(58) Field of Classification Search ..... 52/79.1, 52/79.4, 79.5, 79.7, 79.9, 80.1, 81.1, 81.2, 52/234

See application file for complete search history.

(56) References Cited

U.S. PATENT DOCUMENTS

| | | | | |
|---|---|---|---|---|
| 2,089,059 | A * | 8/1937 | Harley | 52/79.7 |
| 2,363,259 | A * | 11/1944 | Penton | 52/79.8 |
| 2,482,918 | A * | 9/1949 | Kump, Jr. | 52/64 |
| 3,103,709 | A * | 9/1963 | Bolt | 52/69 |
| 3,157,427 | A * | 11/1964 | Reynolds | 296/168 |
| 3,455,075 | A * | 7/1969 | Frey | 52/79.7 |
| 3,500,596 | A * | 3/1970 | Andersson | 52/79.7 |
| 3,566,554 | A * | 3/1971 | Schaffer | 52/64 |
| 3,818,655 | A * | 6/1974 | Carter, Sr. | 52/79.7 |
| 3,822,519 | A | 7/1974 | Antoniou | |
| 3,971,172 | A * | 7/1976 | Gentil | 52/28 |
| 3,984,950 | A * | 10/1976 | Hildebrand et al. | 52/79.7 |

(Continued)

FOREIGN PATENT DOCUMENTS

FR 2623550 A1 * 5/1989

(Continued)

*Primary Examiner* — Brian Glessner
*Assistant Examiner* — Adriana Figueroa
(74) *Attorney, Agent, or Firm* — Sandra P. Thompson; Buchalter Nemer

(57) ABSTRACT

The present invention is directed to a modular room with rectangular floor space, a roof and side walls of a skeletal framework construction with sections, which is designed in such a way that it can be easily assembled, disassembled and connected to other modular rooms. The floor space is formed of a foundation consisting of grid-shaped floor plates, which form partial floor sections of the foundation. Furthermore, the modular room exhibits a support or spine portion that is attached to the roof at its top end and is attached to the foundation at its bottom end.

19 Claims, 26 Drawing Sheets

U.S. PATENT DOCUMENTS 4,083,154 A * 4/1978 Klink ..... 52/79.9
4,124,964 A * 11/1978 Juriss et al. ..... 52/745.03
4,462,390 A 7/1984 Holdridge et al.
4,545,158 A * 10/1985 Rizk ..... 52/79.1
4,726,157 A * 2/1988 Hult et al. ..... 52/79.5
4,879,850 A * 11/1989 Glassco et al. ..... 52/82
5,060,426 A * 10/1991 Jantzen ..... 52/86
5,140,788 A * 8/1992 Lynch ..... 52/63
5,339,798 A 8/1994 Christian
5,402,608 A * 4/1995 Chu ..... 52/79.1
5,473,845 A * 12/1995 Livingston et al. ..... 52/79.9
5,755,063 A * 5/1998 Ohnishi et al. ..... 52/79.8
5,904,005 A * 5/1999 Dyer et al. ..... 52/71
6,581,337 B1 6/2003 Skov et al.
6,604,328 B1 * 8/2003 Paddock ..... 52/93.1
6,609,336 B2 8/2003 Matsubara
6,668,496 B1 * 12/2003 Clapp et al. ..... 52/79.1
6,675,540 B1 * 1/2004 Rokes ..... 52/143
6,735,917 B1 5/2004 Notermann
2004/0103596 A1 6/2004 Don et al.
2004/0118054 A1 6/2004 Thompson
2005/0210762 A1 * 9/2005 Broberg ..... 52/79.1

FOREIGN PATENT DOCUMENTS

WO WO 2006/023545 A2 3/2006

* cited by examiner

MODULAR ROOM AND STRUCTURE

CROSS-REFERENCE TO RELATED APPLICATION

This application is a continuation-in-part of German utility patent application Ser. No. 10/2005/003996.0, filed on Jan. 28, 2005, titled "Modular Room"; a continuation of German community design patent serial number 218490-0001, filed Aug. 19, 2004; a continuation of German community design patent serial number 218490-0002, filed Aug. 19, 2004; and, a continuation of German community design patent serial number 218490-0003.

TECHNICAL FIELD

The present invention relates to a modular room and structure with at least one utility module and at least one living module. More particularly, the present invention is directed to a unique, novel, and nonobvious modular room and structure, preferably comprising a rectangular floor space, a roof, side walls of skeletal framing construction with sections, and a spine or support portion, designed in such a way that it is easily assembled and disassembled and that it can be easily connected to additional modular rooms.

BACKGROUND ART

Modular home systems, which are also called prefabricated homes, are well-established and known. A characteristic of these modular home systems is that they consist of many homogeneous, prefabricated shaped parts. These modular home systems essentially consist of floor-, wall-, door-, window- and ceiling components. Their design is mainly appropriate for one-time construction. Because of this, little or no attention is paid to make certain that the home can also be disassembled, and that the weight of the home is not of any particular interest. Special attention is typically focused on fast assembly. Because of the set structure of many known prefabricated homes, utility components have not been designed to be integrated as compatible systems into the prefabricated homes. In addition, many known modular home systems cannot easily be built onto to increase the size of the home systems and cannot be easily customized onsite. Because many prefabricated homes and structures must be transported in a partially or fully assembled state, they are limited in size and weight due to the limitations of existing trucks or carriers that are used to transport the homes and structures. Moreover, even if known prefabricated homes or structures can be disassembled for transport, it is difficult or impossible for the entire disassembled home to be transported on a single carrier or truck in one trip. Accordingly, there is a need for a new and improved modular room and structure that can be used for residential, commercial, and industrial purposes and that overcomes the problems and limitations associated with known modular home systems.

SUMMARY OF INVENTION

The present invention satisfies these needs, as well as provides a unique and advantageous modular room and structure. None of the known modular home systems provides all of the numerous advantages of the present invention. Unlike known modular home systems, the modular room and structure of the present invention is constructed from parts which provide for easy assembly and disassembly. It is an object of the present invention to make an easily assembled and disassembled room available, which consists of a minimal number of elements with a minimal total weight, and with the roof not having to be supported by support construction on all sides in order to reduce weight. According to the present invention, this object is achieved by a modular room with a rectangular floor space or portion, a roof, side walls with sections of skeletal framing construction, and a support or spine portion. The flooring of the room includes a grid-shaped hollow chassis system which preferably attaches to a foundation of pedestals or ground screws and which forms partial areas of the flooring foundation. The top end of the support or spine is attached to the roof portion, and the bottom end of the support or spine portion is attached to the foundation. In one version, the spine extends arc-shaped above the foundation and ends in a free end. The unique advantage of this construction is that a room is created which may be open on at least three sides, without the appearance of obstructive supports or columns on the side walls. In order to convey a harmonious general impression of the spine and roof, the spine may also be covered with a specially designed exterior visible surface. These and other features and advantages of the present invention will become better understood from the following description and appended claims.

BRIEF DESCRIPTION OF DRAWINGS

Exemplary embodiments or versions of the present invention are shown in the drawings, in which.

DETAILED DESCRIPTION OF INVENTION

The present invention is directed to a novel and nonobvious modular room and structure which can be used for residential, commercial, and industrial purposes, such as for a dwelling, a work space, an office, a business, a retail establishment, or any number of other types of uses. The design of the modular room and structure is modular and modern in size and shape, and is constructed of lightweight materials, such as aluminum, steel, plastic foam, or a combination thereof. However, other suitable lightweight building materials may also be used. The modular structure may be easily assembled and disassembled, is easily transportable, and can be constructed virtually anywhere. In addition, the modular structure is constructed of sturdy materials to withstand and endure hot and cold climates, windy and rainy conditions, and various terrains such as the desert, beach, and mountains.

Figure 1:
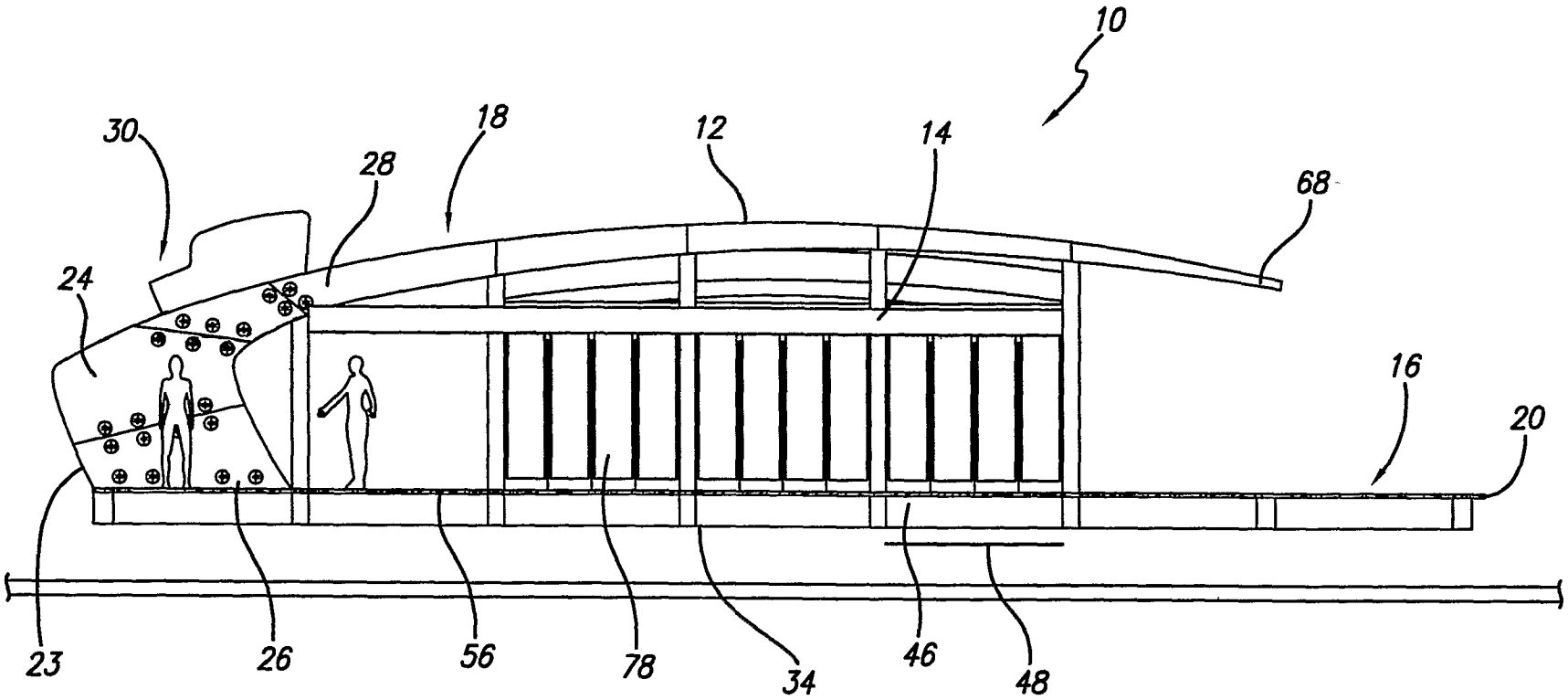
FIG. 1 is side view of a version of the present invention showing a modular room and structure with a terrace or deck.
Figure 2:
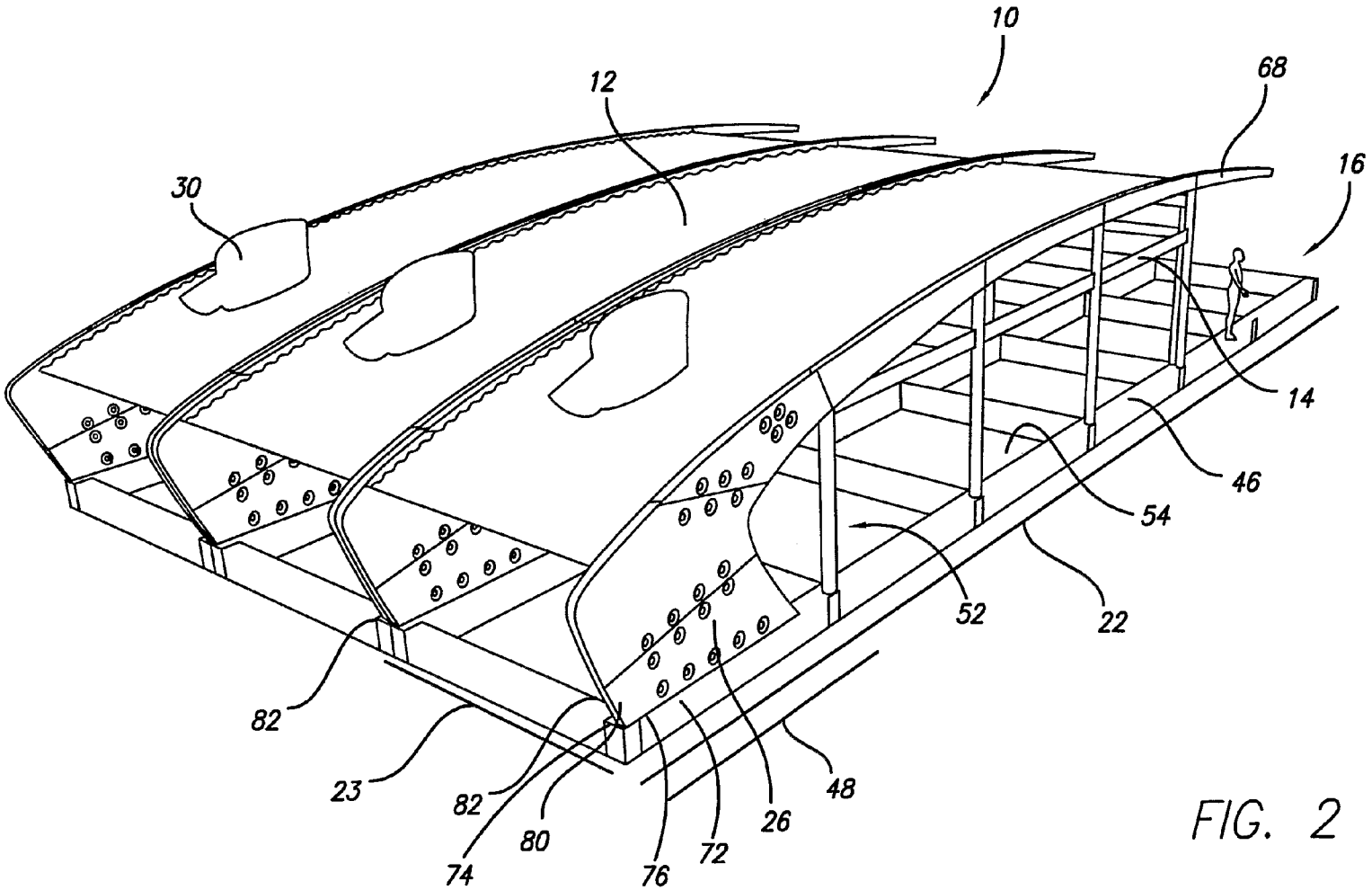
FIG. 2 is a top perspective view of another version of the present invention showing three modular rooms and structures that are attached together along their longitudinal sides.
Figure 3:
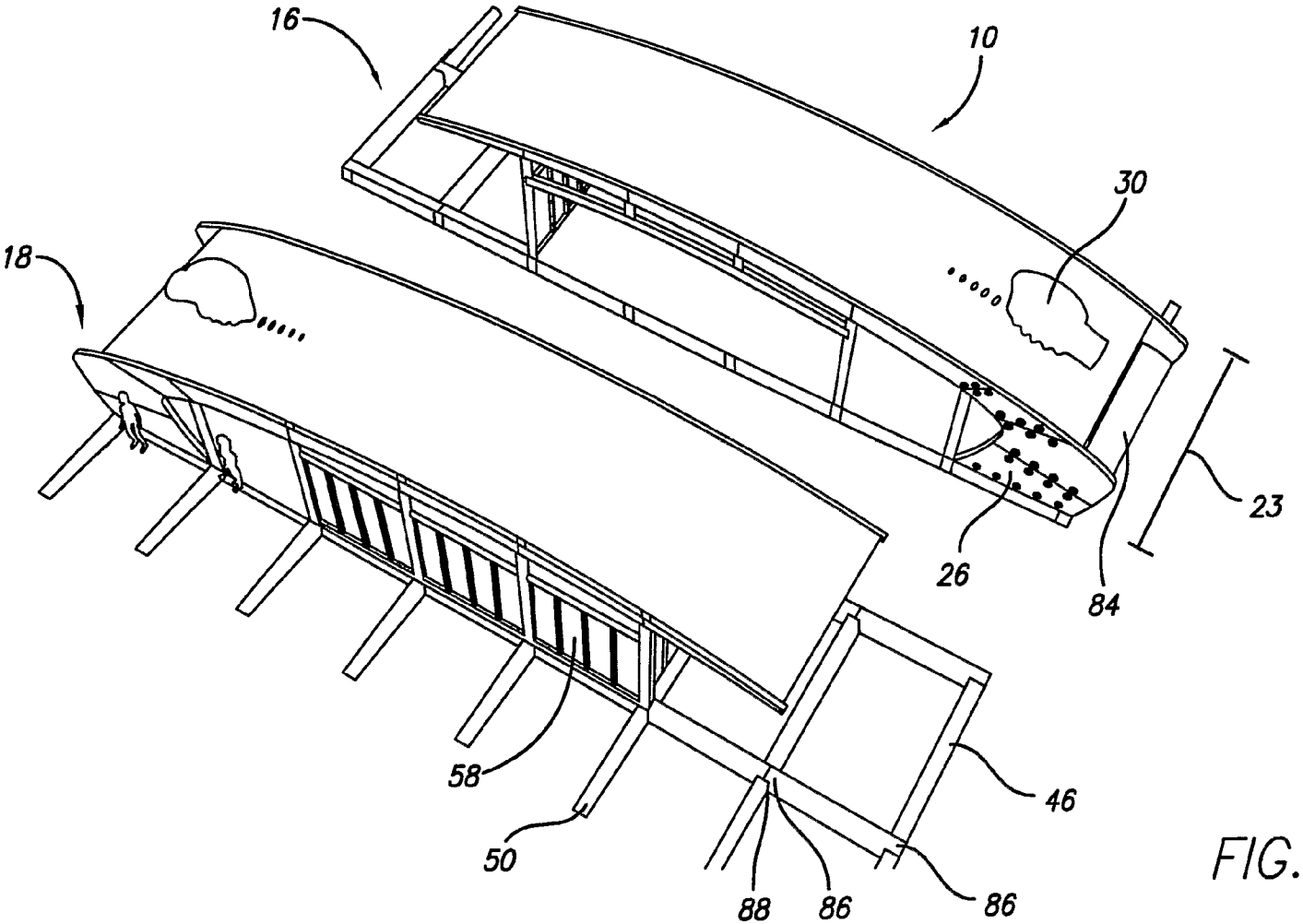
FIG. 3 is a top perspective view of another version of the present invention showing two modular rooms and structures that are aligned together along their longitudinal sides with one of the modular rooms rotated lengthwise 180 degrees around its vertical axis opposite the other modular room.

FIG. 1 shows a side view of a first version of the present invention showing a modular room and structure 10 with a roof portion 12, side walls 14 of skeletal framing construction, a foundation or floor space portion 16, a spine or support portion 18 that connects the roof portion 12 to the floor portion 16, and optionally, a terrace or deck 20. FIG. 2 is a top perspective view of another version of the present invention showing three modular rooms and structures 10 that are attached together along their longitudinal sides 22. The three modular rooms of FIG. 2 are arranged side by side with all three ends 23, at each of which the bottom end of the support or spine is attached, arranged on one side. FIG. 3 is a top perspective view of another version of the present invention showing two modular rooms and structures 10 that are aligned together along their longitudinal sides 22 with one of the modular rooms rotated lengthwise 180 degrees around its vertical axis opposite the other modular room, so that the ends 23, for each of which the bottom end of the support or spine is attached to the foundation, are opposite each other. The two modular rooms are connected side by side to each other in the process of the construction. That way, wind protected terraces are formed at each of the opposite positioned ends 23.

Figure 7:
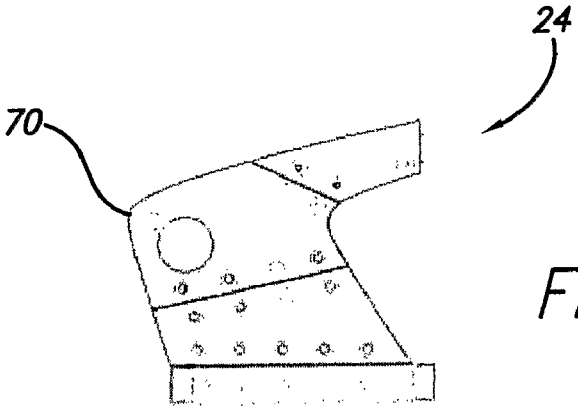
FIG. 7 is a side view of a utility module used with the modular room and structure of the present invention.
Figure 12:
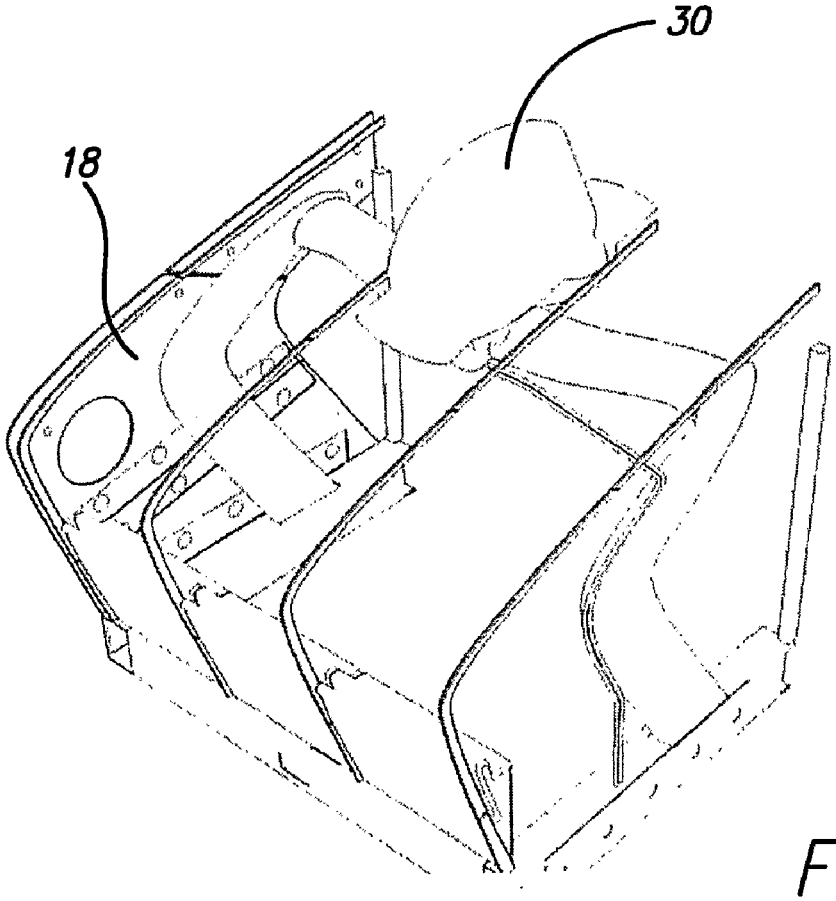
FIG. 12 is cut-away top view of a utility module of a version of the modular room and structure of the present invention.
Figure 18:
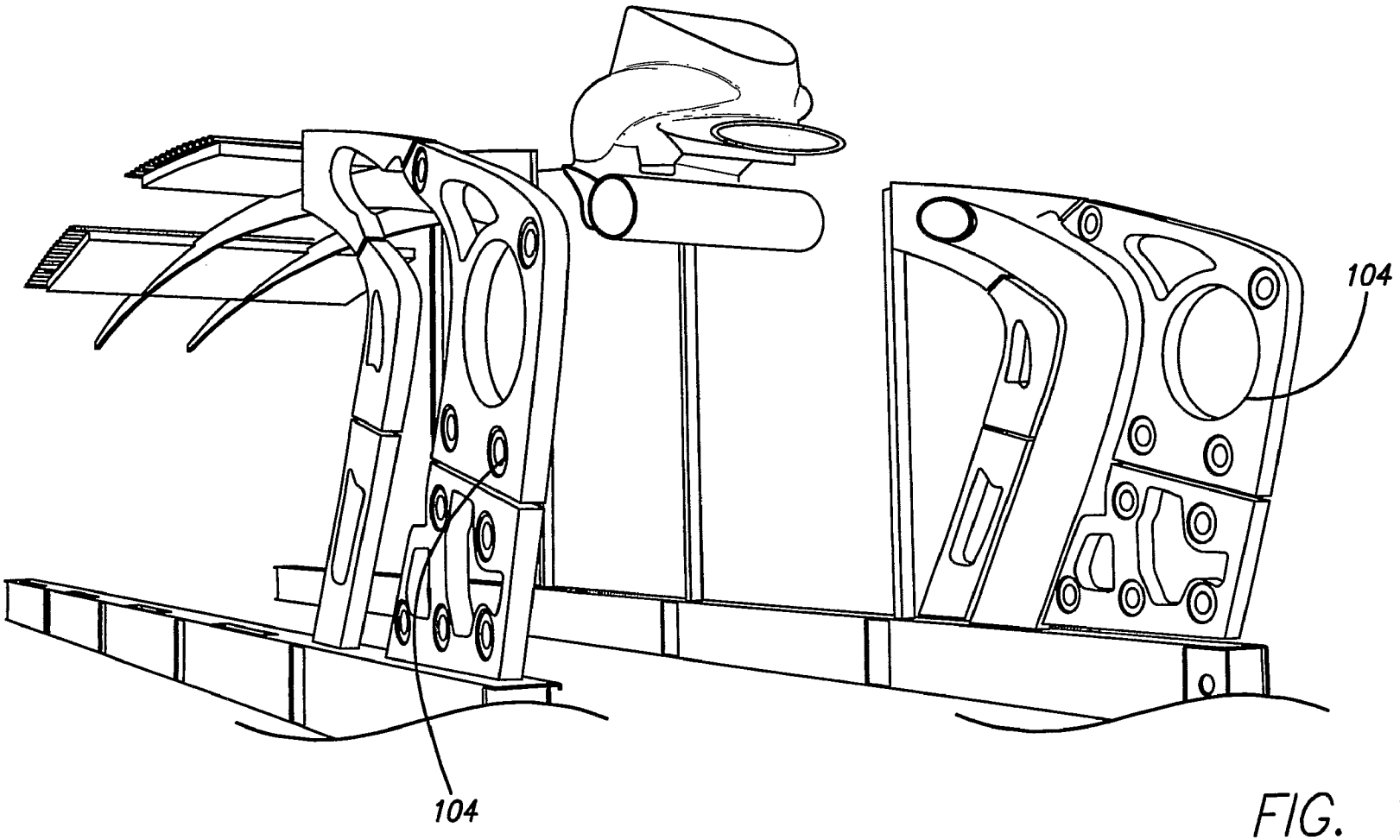
FIG. 18 is a cut-away interior back perspective view of the utility module used with the modular room and structure of the present invention.
Figure 19:
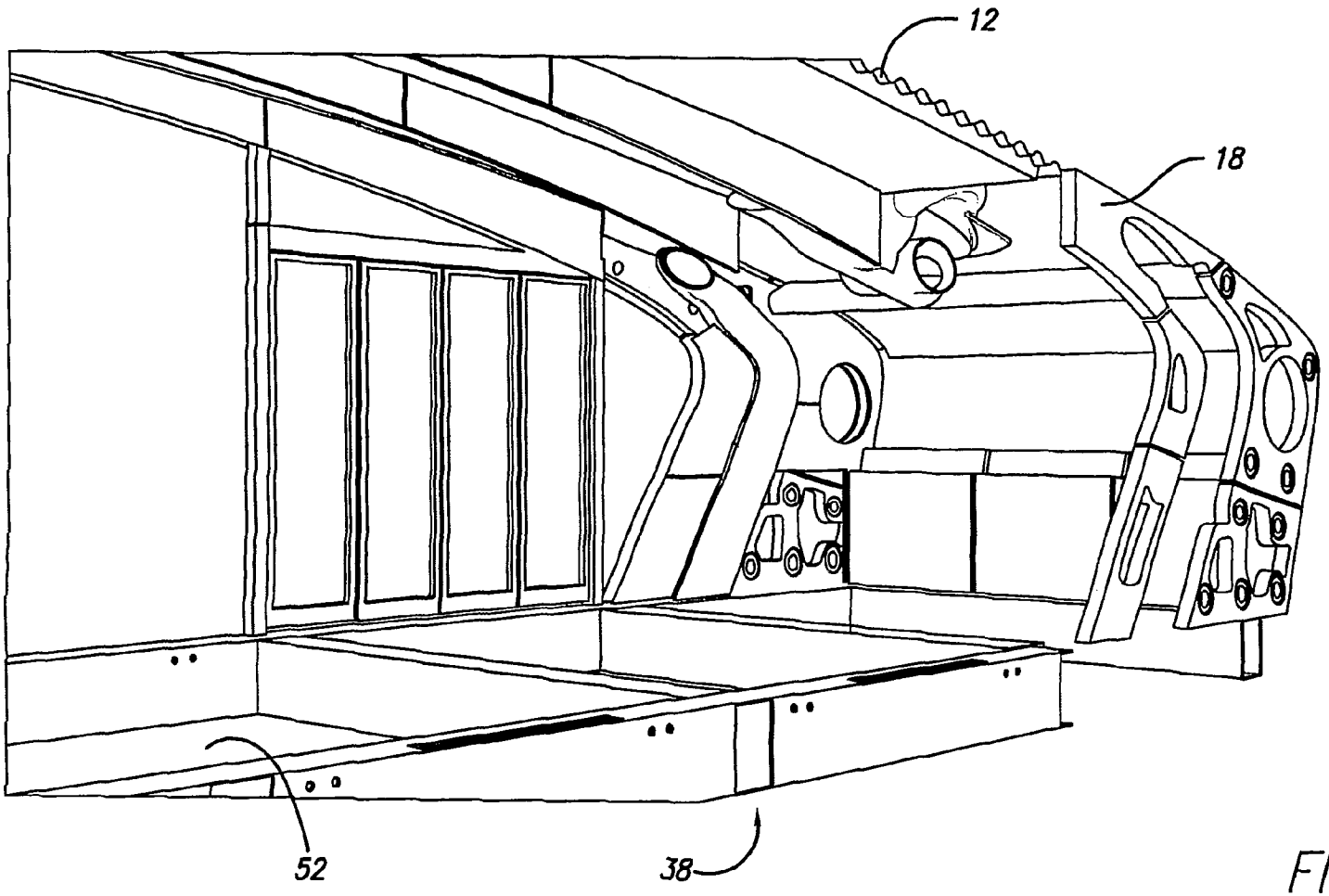
FIG. 19 is a cut-away interior front perspective view of the utility module used with the modular room and structure of the present invention.

The modular room and structure 10 of the present invention comprises at least one utility or technology module 24. The utility module 24 preferably comprises the spine portion 18 which connects at its spine portion bottom end 26 to a portion of the floor 16 and which connects at its spine portion top end 28 to the roof portion 12. The utility module 24 houses such utility elements typically found in dwellings and businesses, such as an air conditioning and/or heating unit 30, a water unit (not shown), a power unit such as for electricity (not shown), a sewage unit (not shown), and a gas unit (not shown). The utility or technology unit, which can be installed as a home technology, climate control system, heating system, electrical system, water supply, kitchen or wet area, is preferably located in the back area of the modular structure. FIG. 7 shows a side view of a utility module used with the modular room and structure of the present invention. FIG. 12 shows a cut-away top view of a utility module of a version of the modular room and structure of the present invention. FIG. 18 shows a cut-away interior back perspective view of the utility module used with the modular room and structure of the present invention. FIG. 19 shows a cut-away interior front perspective view of the utility module used with the modular room and structure of the present invention. Preferably, the utility module 24 is made from materials such as aluminum, steel, a laminate of aluminum and plastic, glass, or a combination thereof. However, other suitable materials may be used to make the utility module. Preferably, the utility module 24 is made of a high quality metal frame with internal insulation material 32. The utility module should preferably have considerable structural integrity, and all parts are preferably replaceable, reusable and refurbishable.

Figure 6:
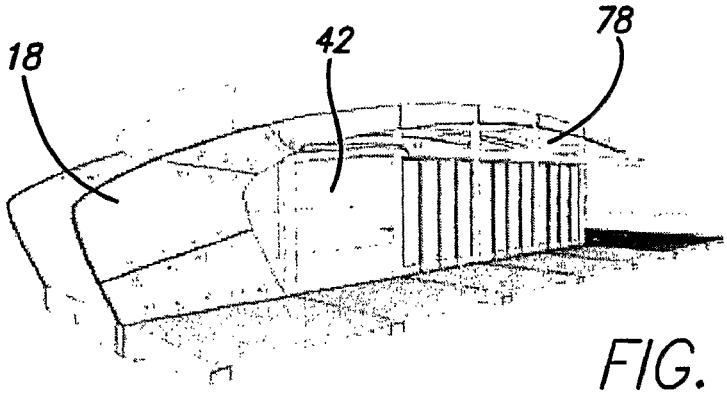
FIG. 6 is perspective view of a version of the present invention showing five module units attached together along their side widths.
Figure 8:
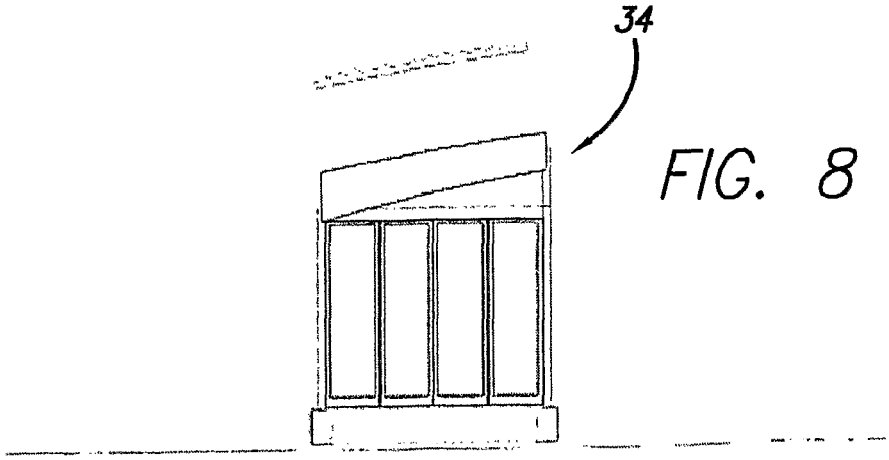
FIG. 8 is a side view of a living module used with the modular room and structure of the present invention.
Figure 29:
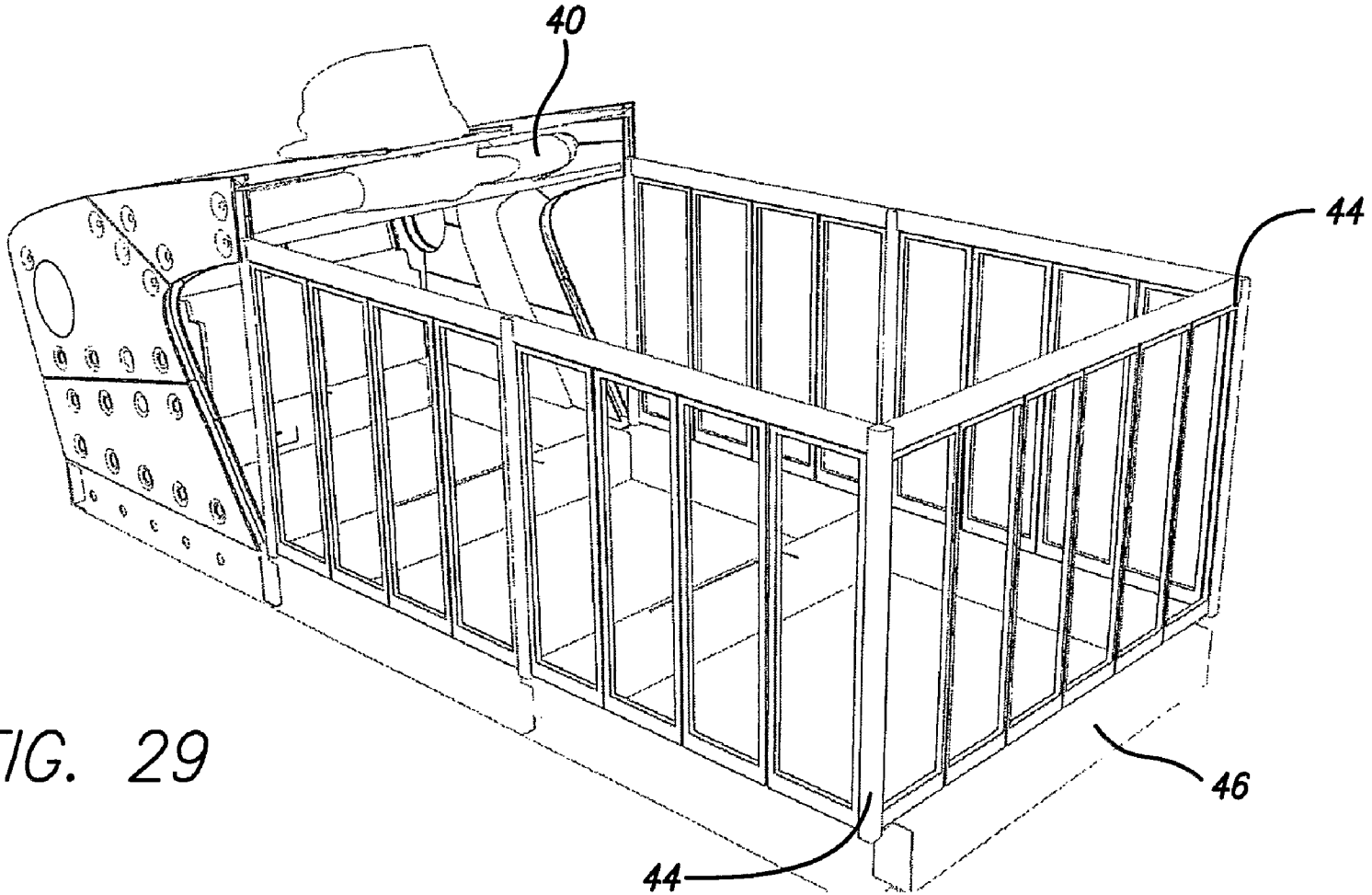
FIG. 29 is a top perspective interior view of a utility module and a living module used with the modular room and structure of the present invention.
Figure 30:
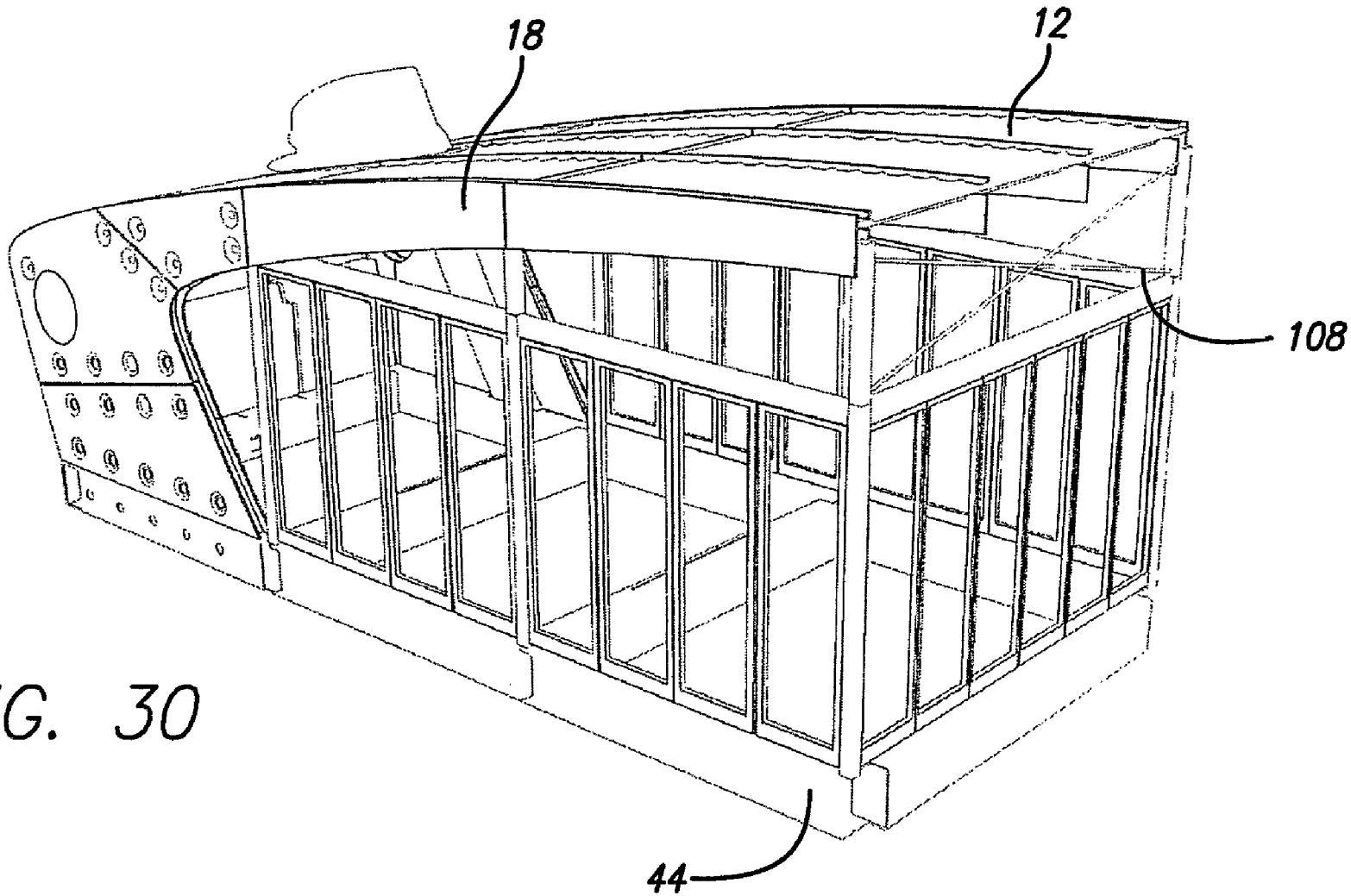
FIG. 30 is the utility and living modules shown in FIG. 29 with the spine projecting over the living modules.

The modular room and structure 10 of the present invention further comprises at least one living module 34. The living module 34 preferably comprises the roof portion 12, the side walls 14 of skeletal framing, and the floor portion 16. FIG. 8 is a side view of the living module used with the modular room and structure of the present invention. FIG. 6 is a perspective view of a version of the present invention showing five living modules attached together along their side widths 36. FIG. 29 is a top perspective interior view of the utility and living modules of the modular room and structure of the present invention. FIG. 30 is the utility and living modules shown in FIG. 29 with the top of the spine projecting over the living modules. Preferably, the living module 34 is made from materials such as aluminum, glass, steel, foam, insulation, wood, or a combination thereof. However, the living module may also be made of other suitable materials.

Figure 10:
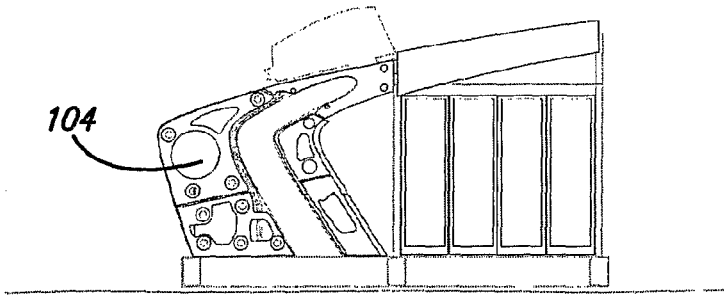
FIG. 10 is a cut-away side view of a utility module and a living module of the modular room.
Figure 11:
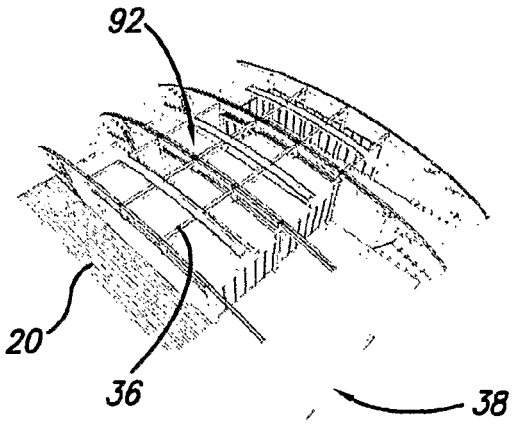
FIG. 11 is a top perspective cut-away view of three modular rooms and structures attached together along their longitudinal sides.

The utility and living modules are assembled together to form a modular room and structure 10. FIG. 10 shows a cut-away side view of the utility module and living module of the modular room. FIG. 11 shows a top perspective cut-away view of several modular rooms and structures attached together along their longitudinal sides 22. The utility 24 and living 34 modules are all made and assembled with structural parts each preferably having a length of no longer than about 14 feet and each preferably having a weight of no more than 100 pounds. These structural module parts can be assembled without a crane and can be easily assembled at most locations. The structural parts of the modular structure are portable and reusable, and may be easily replaced, traded, and recycled. In addition, up to five modular rooms when attached together and fully assembled, which preferably covers about 700 square feet in size, may be easily transported via typical trailer trucks or special load trucks.

Figure 9:
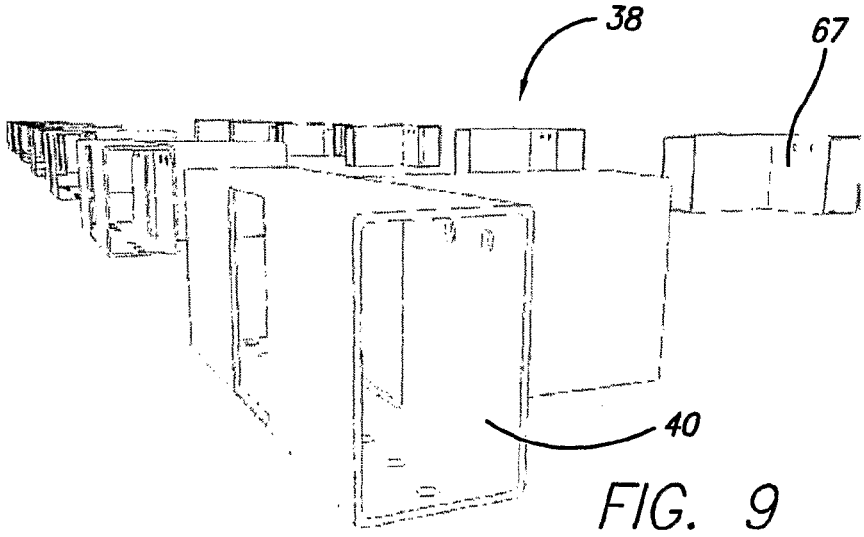
FIG. 9 a perspective view of a chassis system used with the modular room and structure of the present invention.
Figure 27:
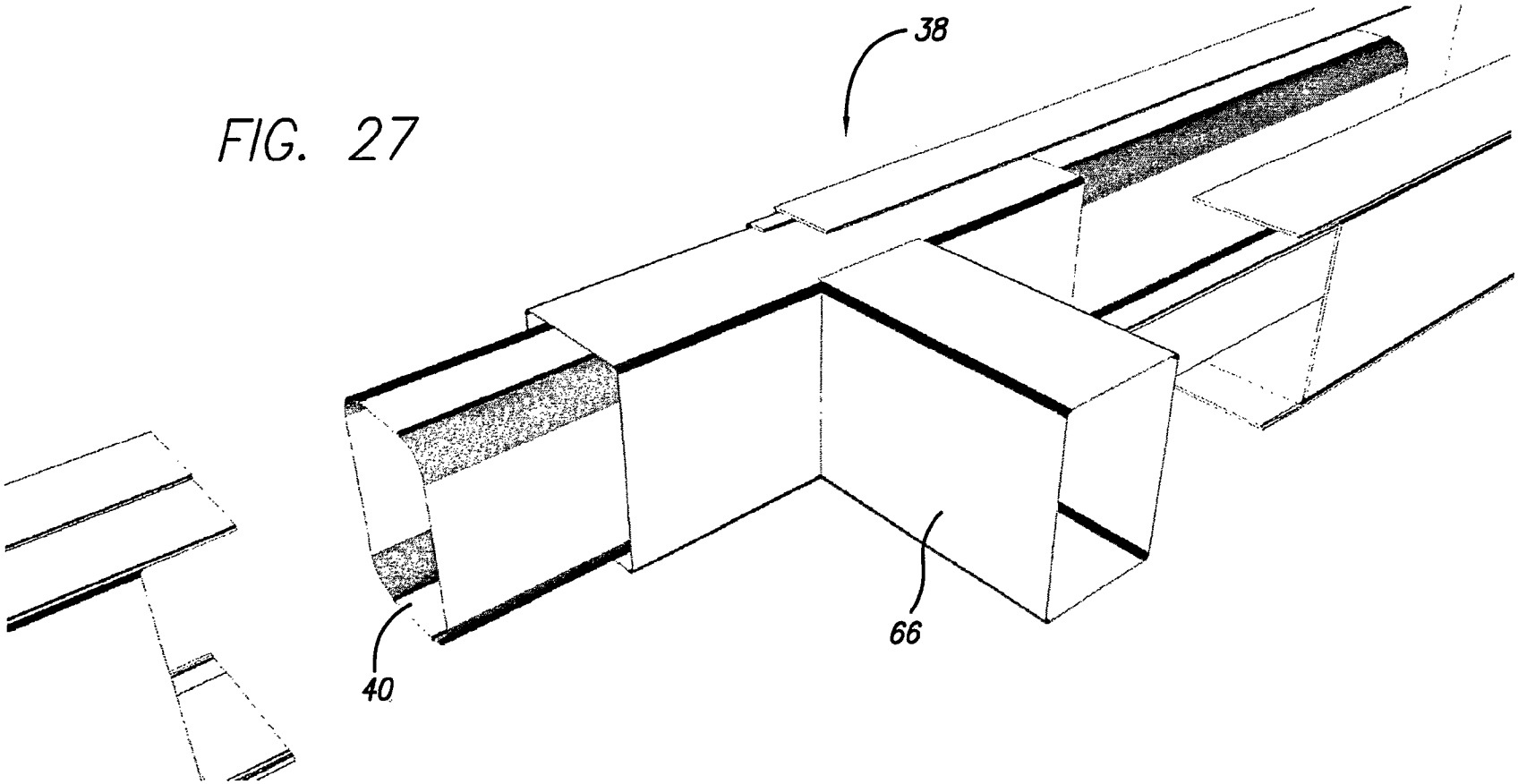
FIG. 27 is a close-up perspective view of a portion of the chassis system and T-shaped element used with the modular room and structure of the present invention.
Figure 28:
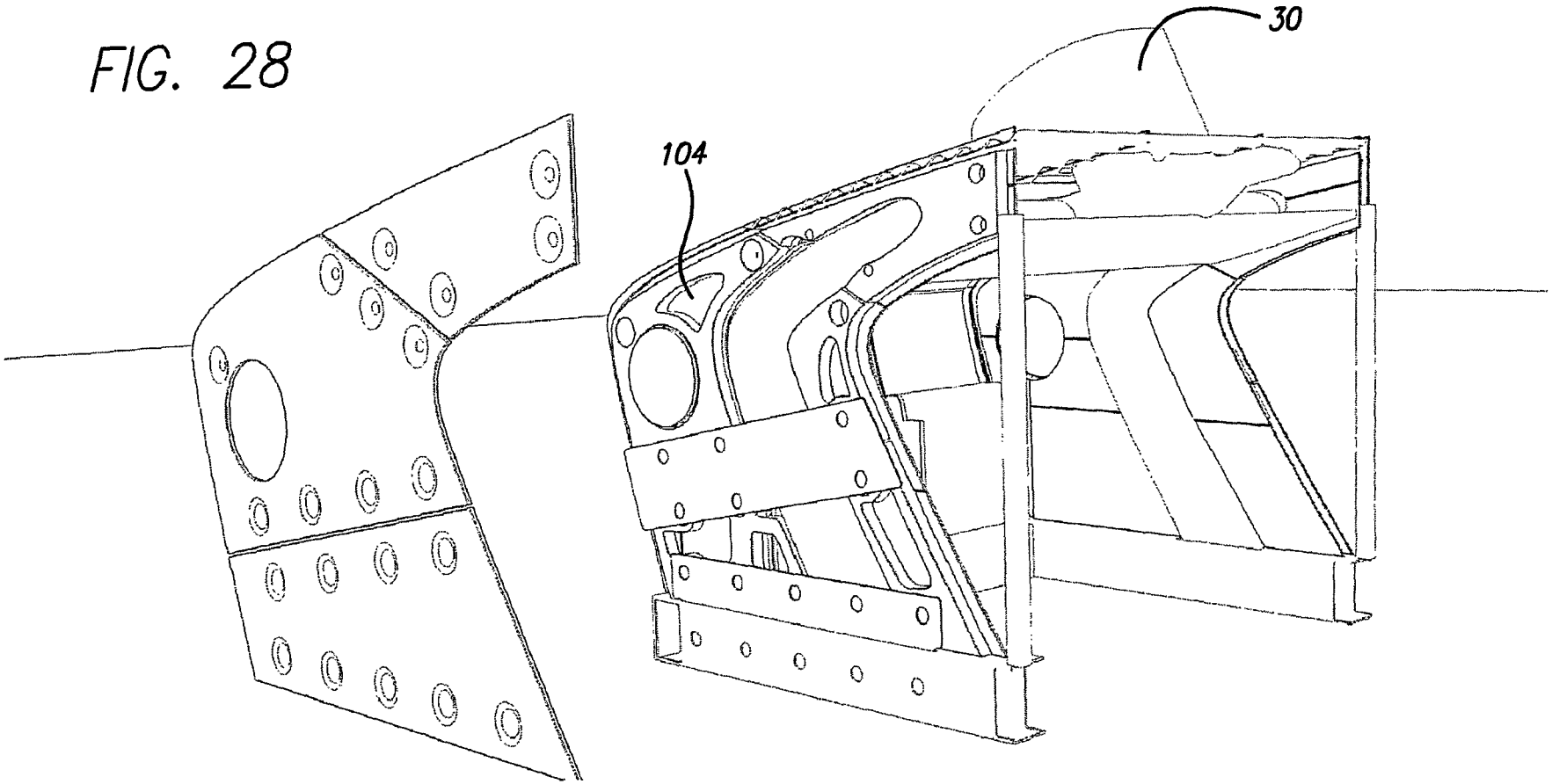
FIG. 28 is a cross-sectional perspective front view of utility modules used with the modular room and structure of the present invention.

As shown in FIGS. 9 and 27, the modular room and structure of the present invention further comprises a chassis system 38 which may be integrated into the floor. The chassis system 38 forms part of the utility module 24 and part of the living module 34. The chassis system 38 is formed by a hollow, lightweight interlocking grid system which provides channels or vents 40 for the cooling/heating systems for the modular room and structure. Any additional living modules 34 added to the modular room and structure get automatically integrated into the chassis system 38. FIG. 1 shows the modular room with rectangular floor portion 16, roof 12, and side walls 14 of a skeletal framing construction with side wall sections or modules 42. The side walls may further be separated by columns or upright beams 44. The chassis system comprises rectangular grid-shaped floor plates 46 which form partial floor sections 48. The rectangular floor plates 46 may be extended sideways by hollow connectors or outriggers 50 (see FIG. 3), preferably made of steel, to form a deck, terrace, veranda, exterior flooring, or extended portion. Each partial floor section 48 is preferably 14 feet long by 10 feet wide, and each has a floor cavity area 52. However, each partial floor section can be of other suitable sizes as well. Preferably, each floor cavity 52 is 12 feet long by 9 feet wide by 1.5 feet deep. However, each floor cavity can be of other suitable sizes as well. The floor cavities 52 may be used for floor heating, storage, sunken living areas, insulation, drainage basins, vacuum hoses, or other various uses. A separate spacer or sub-flooring portion 54 insulates the actual floor 16 from the chassis system 38. Floor panels 56 may be attached to the tops of the floor cavities 52 to create a smooth flooring surface flush with the outside level of the deck flooring. Sliding doors or other suitable doors 58 may be inserted into a groove 60 between interior flooring 62 and exterior flooring 64 (see FIG. 17). The floor panels 56 may be installed on the interior floor portion of the modular room in the form of polyvinylchloride flooring, tile, carpet, or other suitable wall-to-wall floor coverings. The floor panels 56 may be installed on the floor portion exterior to the modular room in the form of wood slats or other outdoor flooring to form a deck, patio, or exterior flooring.

Figure 4:
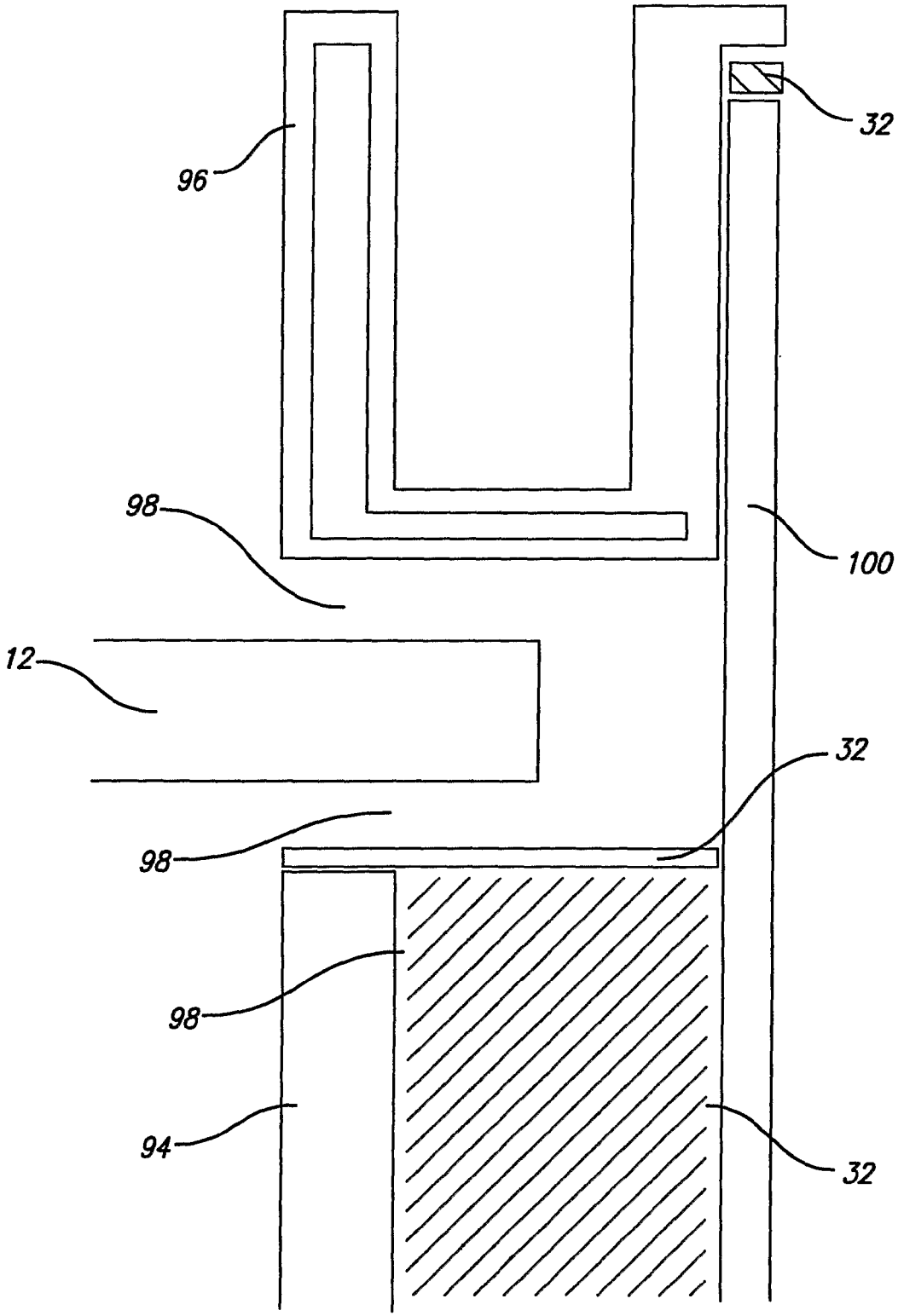
FIG. 4 is a schematic cross-sectional view of a portion of a roof attachment with insulation that is preferably used with the modular room and structure of the present invention.
Figure 5:
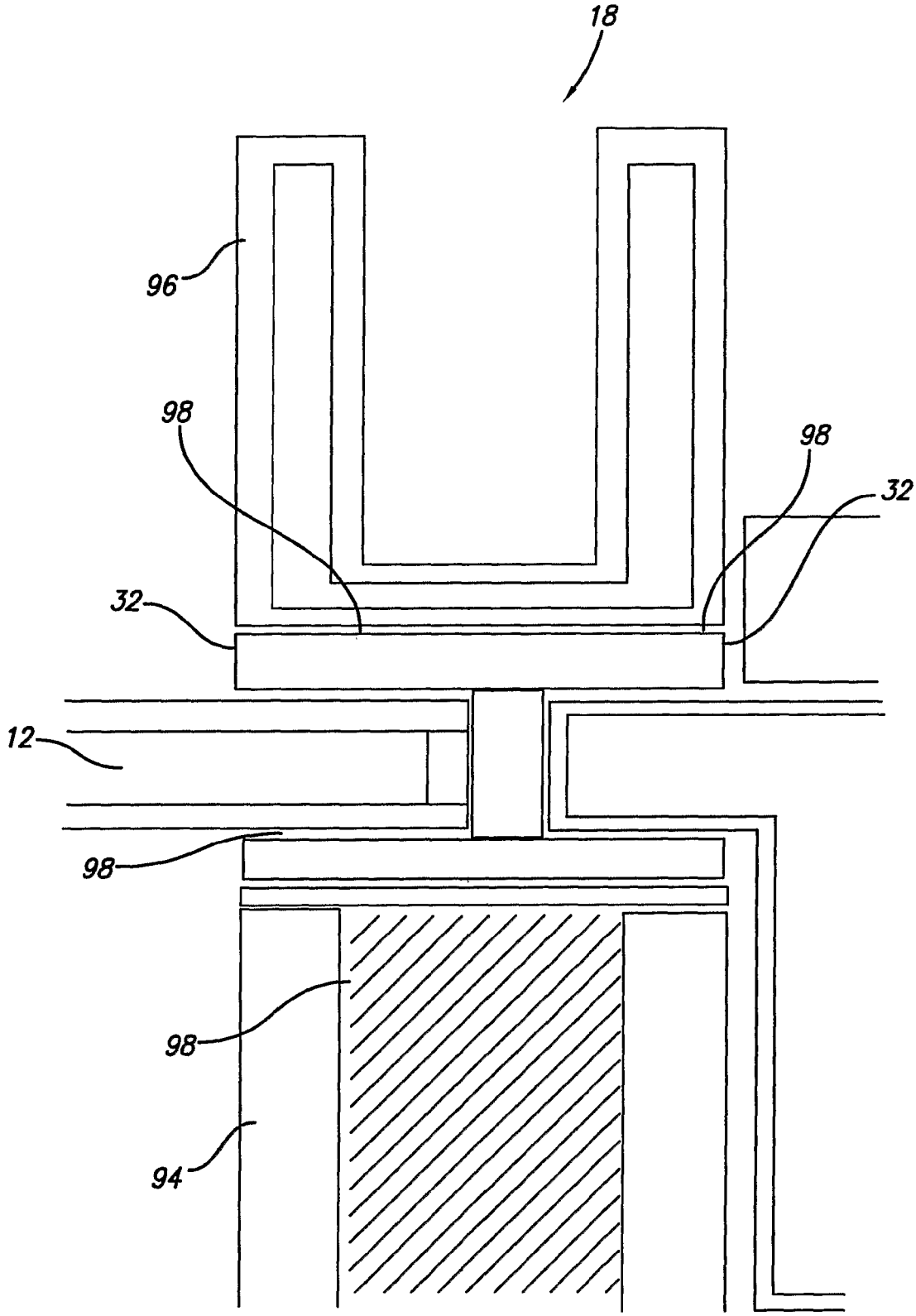
FIG. 5 is a schematic cross-sectional view of a portion of a typical connecting wall-, roof-, and section assembly with insulation that is preferably used with the modular room and structure of the present invention.
Figure 20:
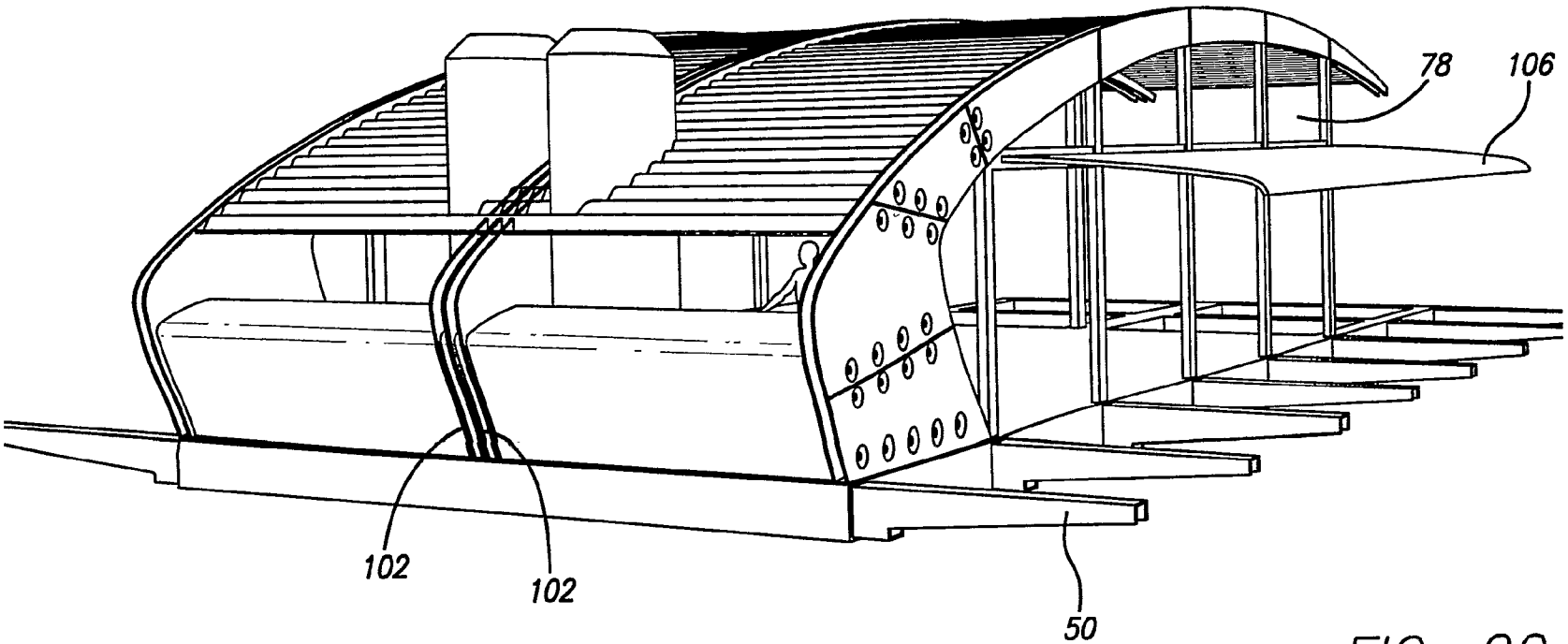
FIG. 20 is a back exterior perspective view of another version of the modular structure of the present invention.
Figure 22:
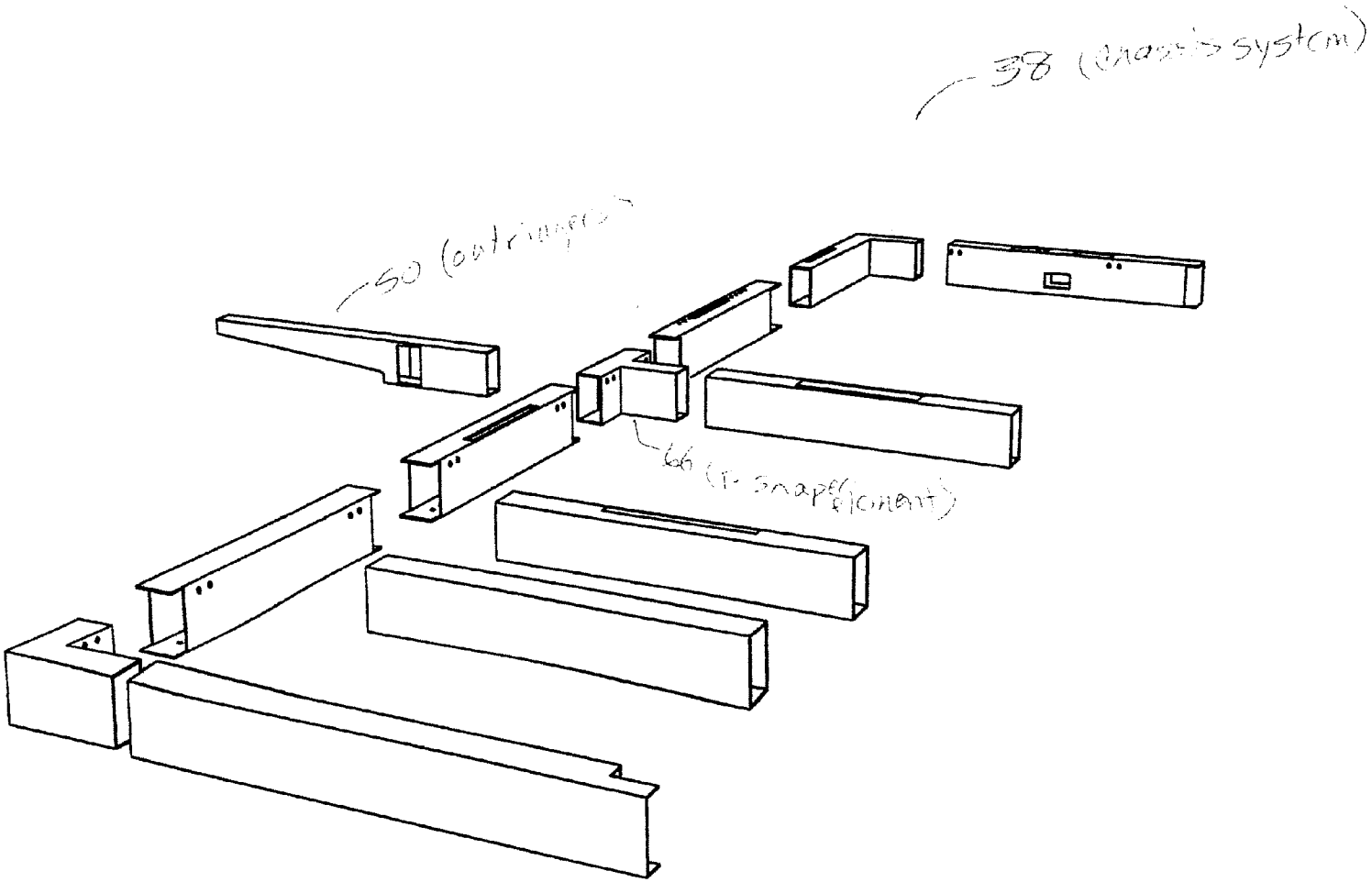
FIG. 22 is perspective view of the chassis system of the modular structure.

A rectangular floor space of the modular room may have longitudinal sides that exhibit at least 2 to 10 times the length of the end sides. Preferably, the longitudinal sides have a length in multiples of 10 feet, such as from 20-70 feet long. Preferably, the end sides have a width in multiples of 14 feet, such as from 14-56 feet wide. As part of the chassis system, a rectangular floor space is created by attaching hollow beam assemblies to each other via internal T-shaped connector beams 66 (see FIG. 27) and L-shaped connector beams 67 (see FIG. 9). A floor space preferably measures about 14 feet in width and about 10 feet in length and can be combined lengthwise preferably up to 70 feet and preferably sideways up to 56 feet. It can also be contemplated for the modular room to be smaller in its floor space than the entire chassis beam system. Because of the larger floor space of the chassis system, one or more decks, terraces, or exterior flooring portions may be built at the longitudinal side or at the end of the modular room. At the longitudinal side, in particular, the option exists to extend laterally past the floor space of the actual room by inserting outriggers 50 preferably in the form of tapered steel supports for additional terrace space. A rectangular floor space is more preferable if two grid-shaped subsections of the foundation form the length of the ends and seven grid-shaped subsections of the foundation form the longitudinal sides of the rectangular floor space. It can also be functional for the modular room to be smaller in its floor space than the entire foundation. FIG. 9 is a perspective view of the chassis system used with the modular room and structure of the present invention. FIG. 20 is a front perspective view of another version of the modular structure of the present invention. FIG. 22 is a perspective view of the chassis system of the modular structure shown in FIG. 20. FIG. 27 is a close-up perspective view of a chassis system and T-shaped element 66 used with the modular room and structure of the present invention. The floor sections of the chassis are preferably oblong or rectangular U-, T- and/or hollow sections. Preferably, the chassis system 38 is made from materials such as aluminum, steel, Teflon, plastic, foam, or a combination thereof. However, the chassis system may also be made of other suitable materials. FIG. 4 shows a schematic cross-sectional view of a portion of a roof attachment with insulation that is preferably used with the modular room and structure of the present invention. FIG. 5 shows a schematic cross-sectional view of a portion of a typical connecting wall-, roof-, and section assembly with insulation that is preferably used with the modular room and structure of the present invention.

Figure 26:
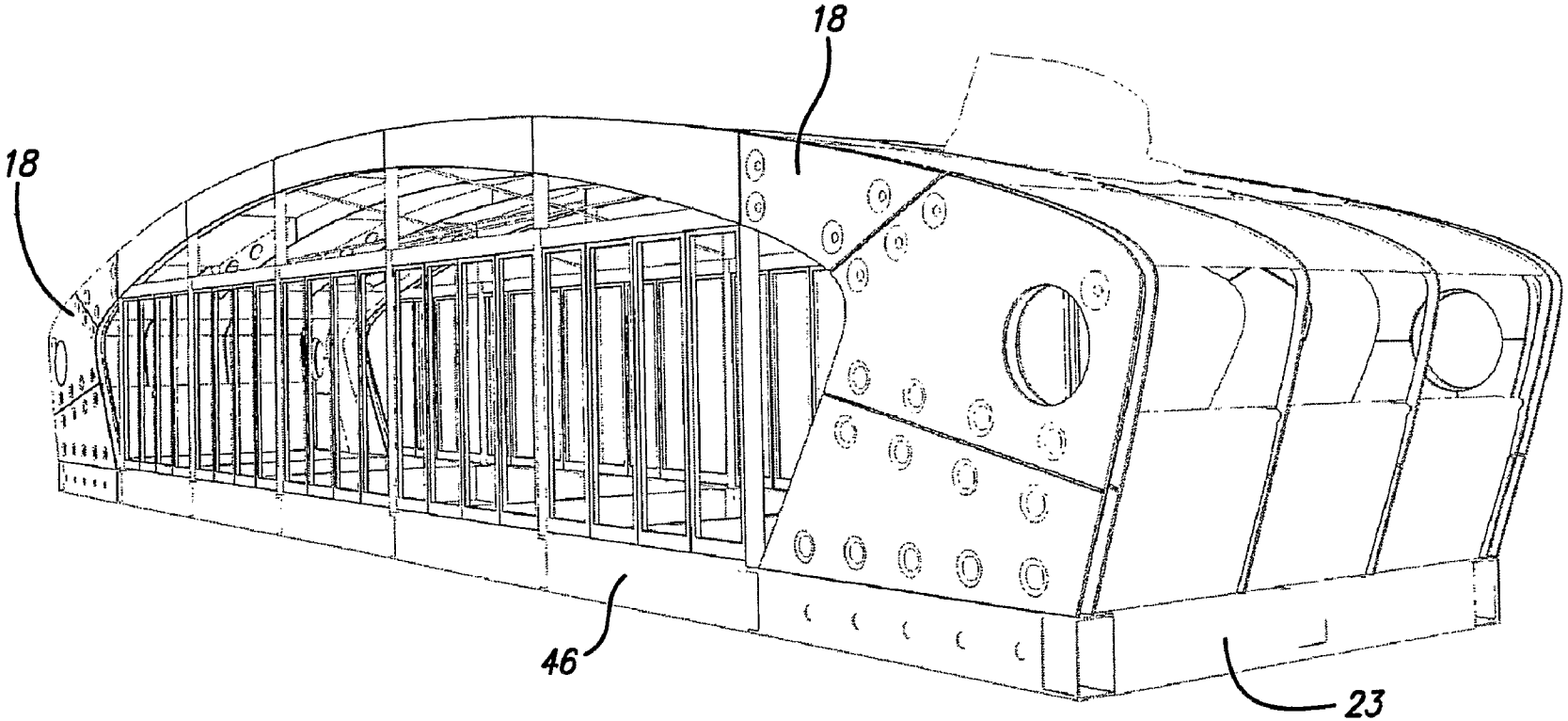
FIG. 26 is a side perspective view of the modular structure shown in FIG. 16.

In one version of the present invention as shown in FIG. 1, the support or spine portion 18 of the utility module spans above the floor portion 16 in an arc-like swing and the top of the spine tapers off at a free end 68. The spine portion 18 is defined by an arc with a wide base and an anticipating curve 70. In another version of the present invention as shown in FIG. 26, the modular room has two spine portions 18 opposite each other such that the spine 18 has no free end 68. The spine portion 18 preferably has a layered design that incorporates the vents, structural insulation materials, water lines, power lines, and gas lines of the utility module 24. The chassis 38 connects to the heating/cooling unit through the spine portion. The support or spine portion which is connected to the floor portion at its bottom end, is arched, starting from the floor portion and projects above the floor. The foundation or floor portion 16 has a longitudinal side portion 72 and an end side portion 74. The support or spine 18 is connected with the floor portion 16 along a portion 76 of the longitudinal side 72. The support or spine 18 exhibits a lateral expansion on its bottom end 26, which corresponds to a partial floor section 48 of the foundation 16 in FIG. 1. In the area of the end side 74, at which the support or spine 18 is connected to the foundation 16, the utility module or unit 24 is housed. The support or spine 18 projects past the framework construction of the side walls 14 by means of, for instance, a partial section. The roof 12 is preferably attached to the top surface of the support or spine 18 and is positioned over the support or spine. As shown in FIG. 1, the side walls 14 of the skeletal frame construction are equipped with window modules 78 in FIG. 1.

As shown in FIG. 2, a support or spine 18 can be positioned parallel to another support or spine 18, so that one support forms an outside support 80 and the other support, for instance, forms an inside support 82. Alternatively, the option exists to provide only one or two supports that are covered with visually appropriate elements in order to impart a visually uniform configuration. Insulation material 32 can be packed between the inside and outside supports. The modular room in its skeletal form means that the side walls, windows, doors, floor plates and utility unit are not installed yet.

An embodiment of the invention is preferable, in which the spine is directly or indirectly connected to the floor sections on the longitudinal side of the foundation. Therewith it is functional, if the support or spine exhibits a lateral expansion at its bottom end, with which it is connected to the floor sections. The attachment of the bottom end of the spine with the floor sections can preferably be carried out, for example, by welding, bolting and/or positive interlocking of the spine with a floor section. The lateral dimension of the support or spine preferably is a surface or is covered outwardly by a visible surface that imparts both a dynamic and harmonious general impression to the support. These surfaces can be removed and reattached to the structure when a new module is attached in its place.

It has been proven to be particularly functional to plan a utility or technology unit for the end area where the support is connected with the foundation. This utility or technology unit can include all of the home technology, such as for example, an air conditioning system, a heating system, electrical system, kitchen, bathroom, laundry facilities, water supply, as well as refrigeration. Preferably, these home service utility components can also be assembled and disassembled in a modular fashion. A modular plug system or built-in planned integration system 104 (see FIGS. 18 and 19) is preferably used with the utility components of the utility module. The wet area includes, in particular, a wash facility consisting of a shower or a shower-tub as well as, if necessary, a separate toilet area. Hollow sections, tubes, or hoses are attached to the climate control and heating system, which are provided for in the ceiling or in the floors of the module and through which air can circulate. Depending on the mode of operation, the warm air of the heating system circulates from the bottom up or the cool air of the climate control system can be blown into the room from the ceilings. The hollow sections or tubes consist of steel, aluminum or light plastic and/or composites. The hoses also consist of common plastics or composites. Any conventional heating and air conditioning system can be used, such as gas, electric, furnace, coal or heating oil. Here, as well, it is very preferable, if the heating and air conditioning system consist of a plug system or built-in units which are matched to the plug system or built-in units of the modular room. Electrical heating and climate control systems are very preferable. An electrical radiant floor heating system, such as heating coils embedded into the sub-flooring panels, may also be used.

As shown in FIG. 3, at each end 74, a swung or arched wall module 84 is attached to the supports 18, which in this case each connect the supports of a modular room with each other. In this fashion, the stability of the supports 18 with regard to lateral force effects can also be increased. The layout of the grid-shaped floor plates 46 extends beyond the pure floorplan of the modular room 10, in order to be able to form a terrace, covered with floor panels 56. The floor panels 56 have projecting sections 86 at their ends, whose outside surfaces 88 can overlap the floor panels 56 that are positioned vertically to them. The floor panels or outriggers at the longitudinal sides 72 of the modular room taper off towards the outside in order to reduce weight. Floor panels may be attached to the grid-shaped floor beams. The special advantage consists of the fact that the foundation that sits on the ground, as such, forms a flat and stable structure, to which the floor plates can be attached. It is understood that the floor panels can be attached in various conventional ways to the floor plate chassis system.

The floor plates that are attached to the flooring portion can be shaped in such a manner that they form the floor inside of the modular room and a floor outside the modular room. It can be particularly functional to match the size of the floor plates to the size of the subsections of the foundation so that they are formed of one piece. Depending on need, they can also be constructed of several pieces. The floor plates can be made of metal, wood, plastic or any compound.

In the interior, radiant floor heating can be installed with the floor covering, be it structured, unstructured or a smooth surface. Naturally all kinds of carpet, laminate, parquet, PVC, plastic or compound materials come into consideration. If necessary, it can prove to be functional to install common insulation materials under the floor panels.

The roof 12 in one version may cover four partial sections 48 of the six partial sections 48 of the foundation 16. Each roof section comprises an exterior roof layer, a middle insulation layer, and an interior ceiling layer. The outer layer of each wall panel is removed when the structure is expanded across its width and reapplied to the new section. The exterior side wall panels are removable and reusable when additional modular rooms are attached to an existing modular room. In the space between two modular rooms, a waterproof spacer element may preferably join together the roof portions of each modular room. The inner layer of the roof provides the roof support and an internal gutter (not shown) which is preferably positioned on top of insulation material. Each roof section of the roof has an interior gutter located between the exterior side walls and the interior support structure. The roof curvature across the living modules is constant. Thus, several modular rooms can be connected along the longitudinal sides 22, providing unobstructed living space of at least 50 feet long by 42 feet wide and more, with three modular rooms side by side. The roof portion 12 is preferably made of layers of materials sandwiched together, such as exterior panels of corrugated steel, middle layers of insulation, and interior panels that form a wood finished ceiling. Preferably, the exterior panels of the roof portion 12 are comprised of such materials as corrugated steel, stainless steel, aluminum, copper, composites, glass. However, the roof portion may also be comprised of or include other suitable materials, such as solar cells, specialized glass coatings, integrated piping, sunroof openings, glazed skylights, shade panels, and materials made with surfaces using nanotechnology. The spine portion 18 may also include a guide rail 90 for a shading or sliding panel or a heavy snow protector for cold climates. The frames which define the gutter at the edge of the roof can be used as guide rails for sliding shade panels or solar panels or heavy snow protectors. The air conditioning/heating unit 30 located in the utility module 24 preferably provides reversible air flow to the attached living module or modules 32 via the spine portion 18, the chassis system 38, and vent 40 along the center of the roof portion 12

The foundation or floor portion 16 may be preferably attached to earthen ground, with the exception of sand or rock, via large stainless steel screws (not shown) that are preferably about 4 feet in length and can be inserted at anchor point portions of the rectangular floor plates 46. Preferably, for example, a modular structure comprising one utility module and one living module would have 6 large screws, one located at each corner of the grid. Preferably, for example, a modular structure comprising one utility module and four living modules would have 12 large screws, one located at each corner of the grid. If the modular structure must be moved to another location, the large screws can be easily removed with little or no damage to the area it occupied. As an alternative to using the large stainless steel screws, foundation pedestals or natural rock may also be used.

As shown in FIG. 1, the modular structure with one utility module and four living modules typically is of a size of 700 square feet and may have up to 37 doors. The side doors of the modular structure of the present invention are preferably the same size and preferably about 28 inches wide by about 96 inches tall. In addition, preferably the side doors open or fold outwardly. Side door sections may be replaced with louvered wall sections or vertical sliding window panels. Preferably, the front and back doors at the front and back ends of the modular structure are narrower than the side doors. However, all the doors may be customized. The doors may be replaced by window modules 78 or side wall modules or panels 42 as needed. The windows or wall panels are preferably of a size of about 9 feet 8 inches wide by about 8 feet tall. When additional modular rooms or structures are attached, the window or wall panels may be removed and reused elsewhere. For example, if an additional utility module and an additional living module are added to an existing utility and living module, the exterior panels of the utility module would be removed, the exterior panels of the existing roof portion would be removed, and the exterior window or wall panels of the living module would be removed. All of the removed panels could be reused with the new additional utility and living module. The outside facing window or wall panels may be removed and reused when more than one modular room is attached together. The modular structure may be mirrored across its length with the curvature of the roof remaining constant up to the utility module.

The interior space 92 of the modular structure may be left open or divided by wall panels made of a suitable material such as glass, drywall, tiles, wood, steel framing, or other suitable materials. Preferably, the bath and kitchen areas that utilize water and electricity will be located near the utility module. The modular structure of the present invention may be comprised of a single modular unit or may be comprised of several modular units attached in a variety of ways to provide such areas as an interior courtyard, sun and glass roofs, solar panels, sliding shade panels, lockable awnings, and wind breaking deck or veranda areas.

A further substantial advantage of the modular room consists of the fact that two to three of the side walls consist of a skeletal framework construction and thus can be replaced with an integrated window front. Because of the special layout of the rectangular floor space with the roof supports and the skeletal framework construction, a uniformly shaped and particularly graceful transportable room with integratable utility or technology units is made available. Because of the skeletal framework construction of the side walls, different wall modules, dividing walls, partition wall modules, wall modules with window and/or door, windows, doors, sliding doors, and roll gates can all be inserted, so that depending on design request or need, the side walls, whether they serve as interior or exterior walls, can be varied.

In order to support the lighting conditions and also the living quality during bad weather, it is very preferable to let the spine project beyond the skeletal framework construction of the side walls at its tapered end in order to create a projection at the front of the modular area. This projection can be used for the roof, however it can also prove to be advantageous, if shades that are either manually adjustable or programmable, dependent on the lighting conditions, are installed there. Also conceivable is an adjustable awning 106 that can be adjusted manually or automatically.

The entire roof can consist of conventional roofing materials such as asphalt and plastic composites, corrugated steel, corrugated board, which can also be coated, as well as steel, glass or various types of plastic. If necessary, the entire roof or parts of it can be retractable or be designed with sky lights. Depending on the region and the climate it can be appropriate to equip the roof with common thermal insulation or special coated glass that, for example, reflects infrared radiation. Also conceivable is the use of glass plates that can be programmed to darken.

The roof may be constructed of roof sections. The roof sections are preferably of equal length and equal width to the floor plates or section, and the roof sections may be connected with upright support columns to the flooring portion. Each roof section may be comprised of preferably four roof beams 108 which are preferably constructed of such materials as aluminum or steel, and the roof beams are preferably positioned parallel to each other. Preferably, on top of the roof beams are placed roof panels or sections which may be made of corrugated stainless steel or other suitable materials. Between the roof beams are positioned insulation materials and the air conditioning and/or heating ducts or channels. Preferably, below the roof beams are attached interior ceiling panels. Of the four roof beams, the two outer beams support the interior roof gutter and provide the connection or attachment areas to the upright columns or beams and the exterior removable panels or modules. At least five roof sections may be continuously attached to each other in a conventional way without the need for an upright column or beam, so that at least a 50 foot spanned space may be available. All of the conventional connecting systems may be used for the connection of the laminate elements to the support sections. Each support column or beam can exhibit several L-, I- or U-shaped sections. The roof can be connected to the spine with the support columns or beams at the sides of the side wall or window panels or modules. It is very preferable that the roof does not come into direct contact with the support columns or beams so as to avoid thermal bridges which conduct a temperature exchange between the interior and exterior of a building leading to condensation, especially with metal structures. Preferably, gaps 98 are provided for between the roof and the support beams, and/or between the spine, into which the usual insulation materials can be packed. In this way it is possible to prevent the thermal bridges that are possible with structural steel. In order to eliminate all thermal bridges, it is advisable to insert additional insulation material between the external support columns or beams and the inside elements. This can be achieved by, among other things, a special insulating coating, insulating foils or other such items.

In order to accommodate the utility or technology unit, which can also consist of modules, in a central space-saving place and/or for structural reinforcement, wall modules that interconnect the supports of a modular room or also the supports of two modular rooms are planned for the area of the utility unit. These wall modules can be provided with doors and/or windows. In order to support the total visual concept, these wall modules are also ideally designed to follow the arched curves of the structure.

The floor sections that form the foundation of the modular room, are functionally oblong or rectangular and formed as U-, T- or hollow sections. The hollow sections are preferably shaped oblong rectangular and rest with their narrower sides on the one hand on the ground and on the other hand serve for the attachment of the floor plates. The connection of the sections among themselves can take place by means of L- or U-shaped extending sections at the ends of the sections, with the extending sections overlapping the outside surfaces of other sections and are connectable with conventional bolting.

In particular, the projecting sections attach to the outside surfaces of right-angled sections.

FIG. 4 shows a possible configuration of the fastening and insulation of the interface between the roof 12 and the support 18. The edge of the roof 12 is between an I-shaped section 94 and a U-shaped roof section 96, which exhibits the support. A gap 98 can be formed between the roof 12 and the sections 94, 96, into which insulation material 100 can be packed. At the same time, insulation material 32 can be packed between the individual elements (section 96, exterior visible surface 100) of a support 18, which, in this case, is an outside support with a separate visible surface. That way the formation of thermal bridges, as discussed above, can effectively be eliminated, which otherwise, with steel-glass construction, would result in water condensation in the room.

FIG. 5 shows a possible configuration for I- and U-shaped sections 94, 96 of a partition wall support in the area of the roof 12. Insulation material 32 is packed into the gap 98 that develops.

Figure 13:
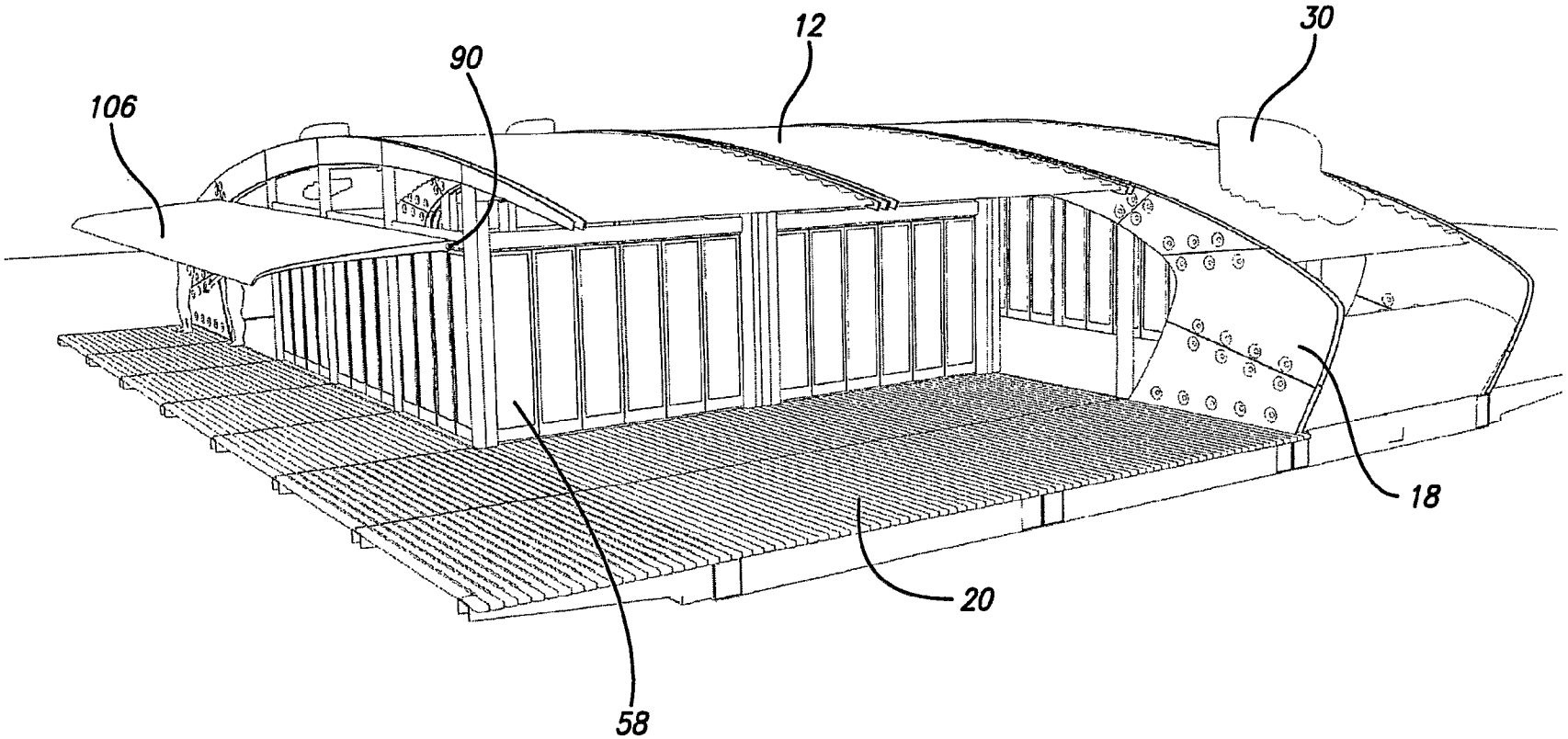
FIG. 13 is a perspective view of another version of the modular structure with a deck.
Figure 14:
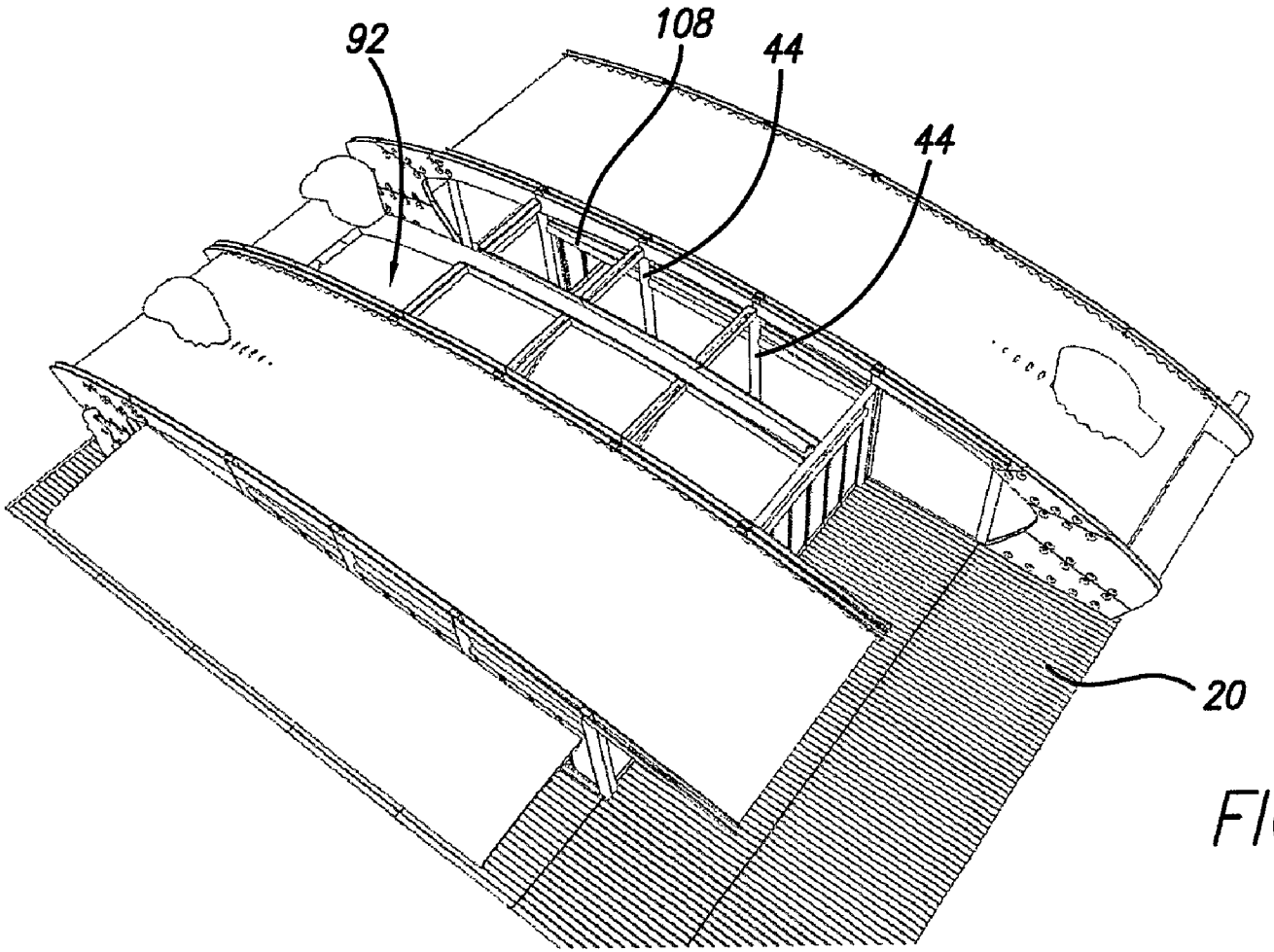
FIG. 14 is a top exterior perspective view of another version of the modular structure with a deck and an awning.
Figure 15:
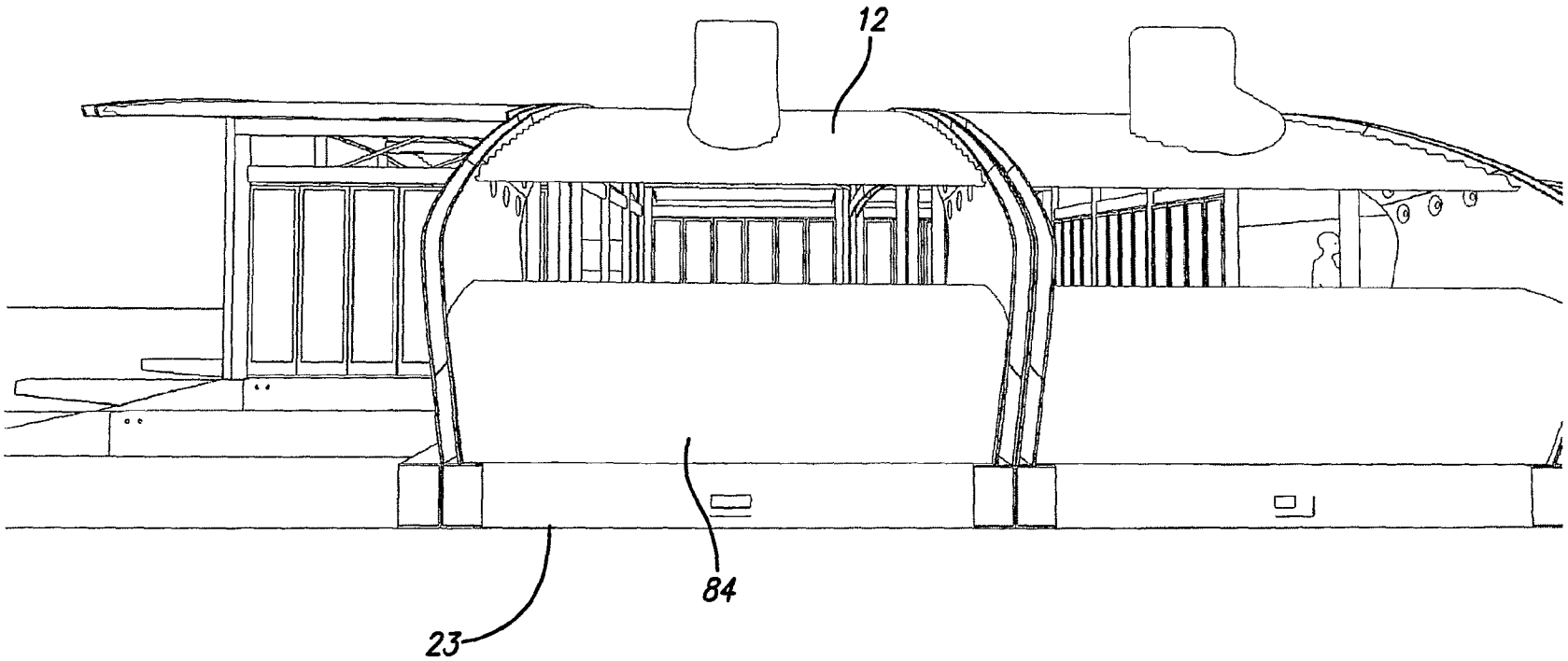
FIG. 15 is a back exterior view of the modular structure of FIG. 14.
Figure 16:
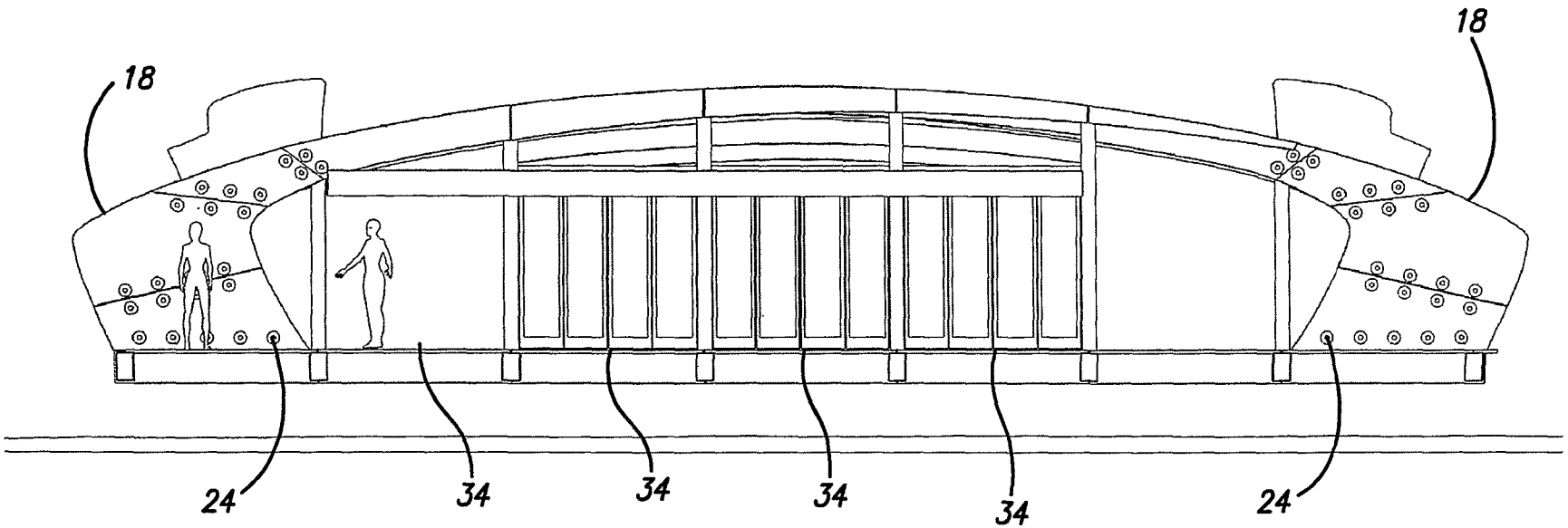
FIG. 16 is side exterior view of another version of the present invention showing a modular structure with utility modules at opposite ends to each other.
Figure 17:
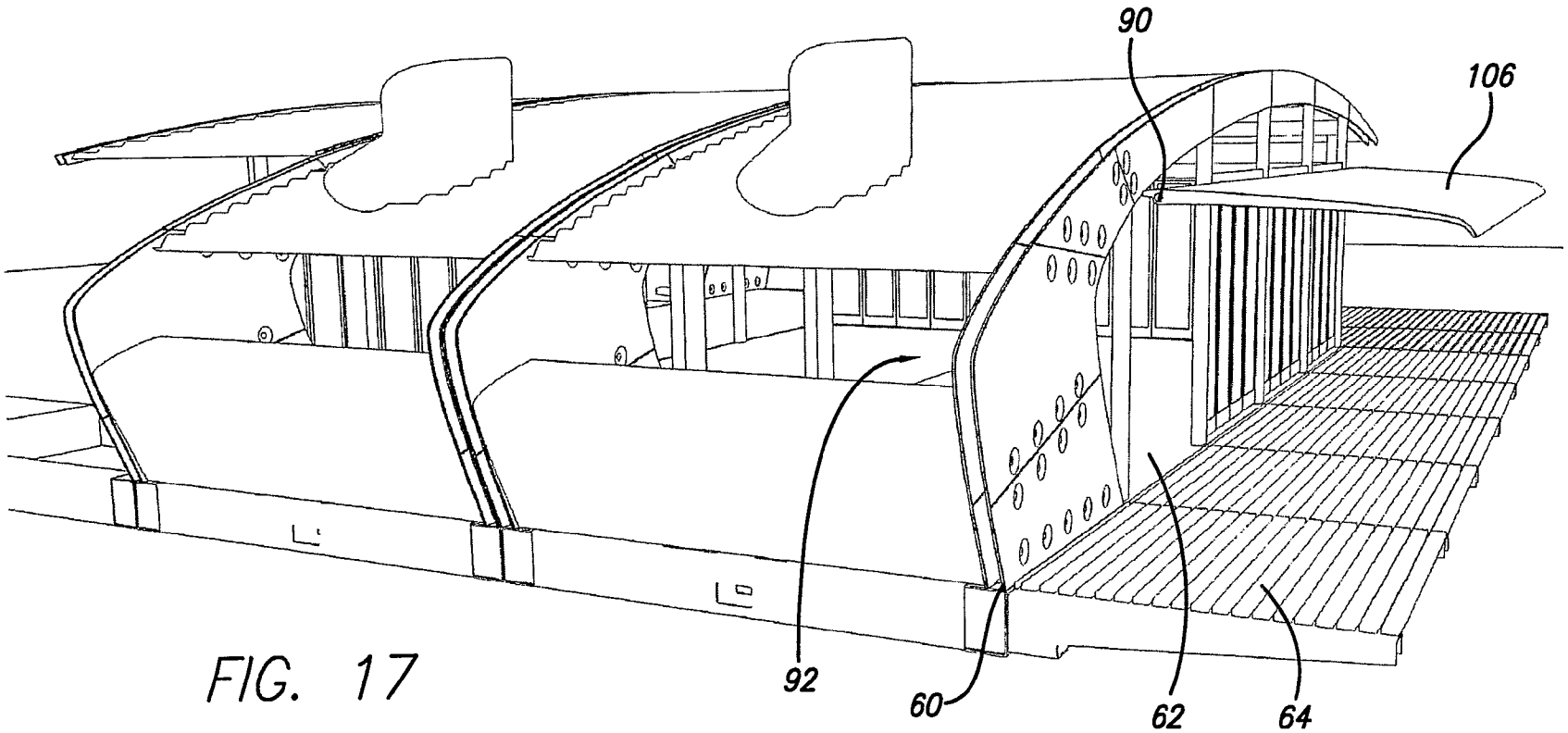
FIG. 17 is a back exterior view of a version of the modular structure of the present invention.
Figure 21:
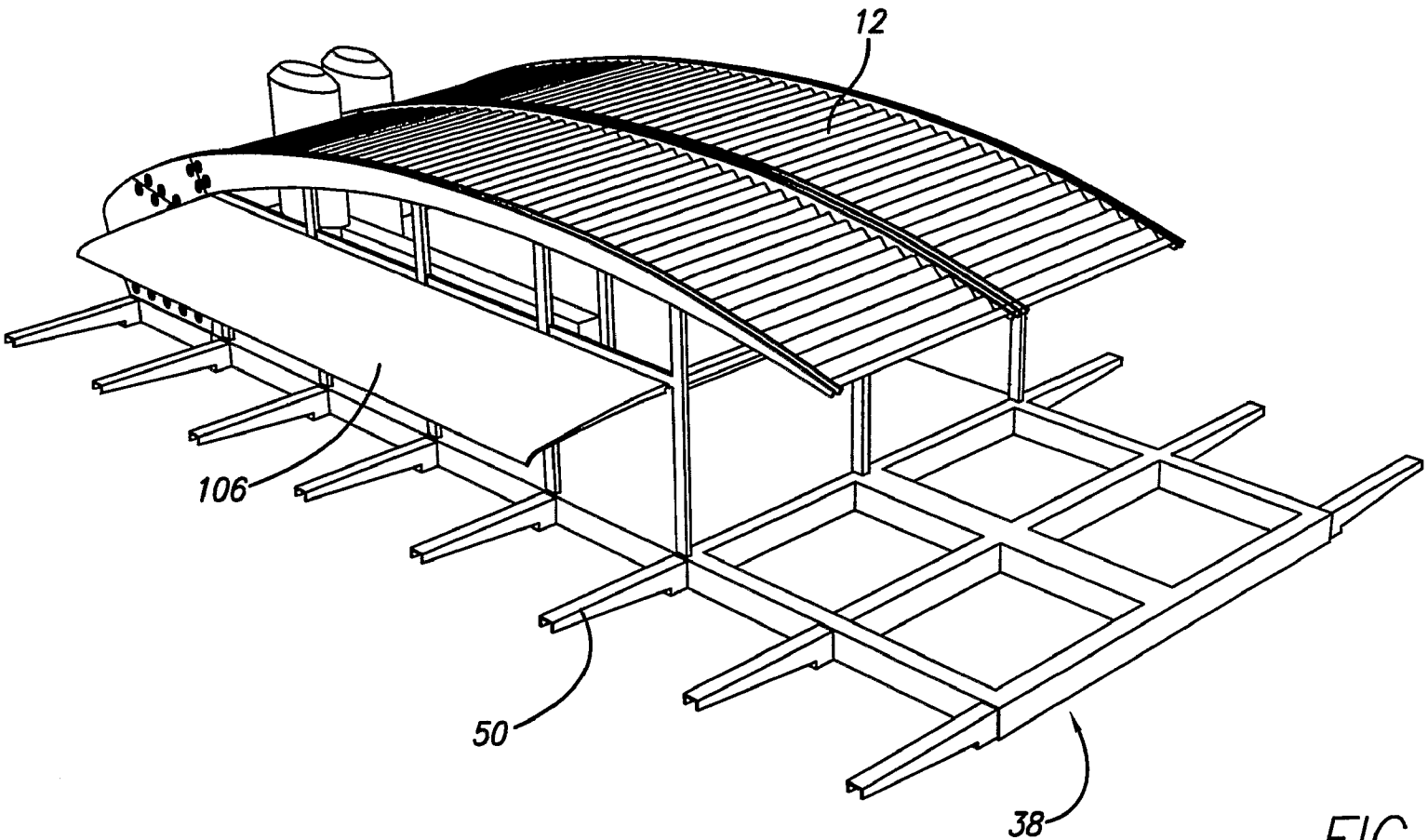
FIG. 21 is top exterior perspective view of the modular structure shown in FIG. 20.
Figure 23:
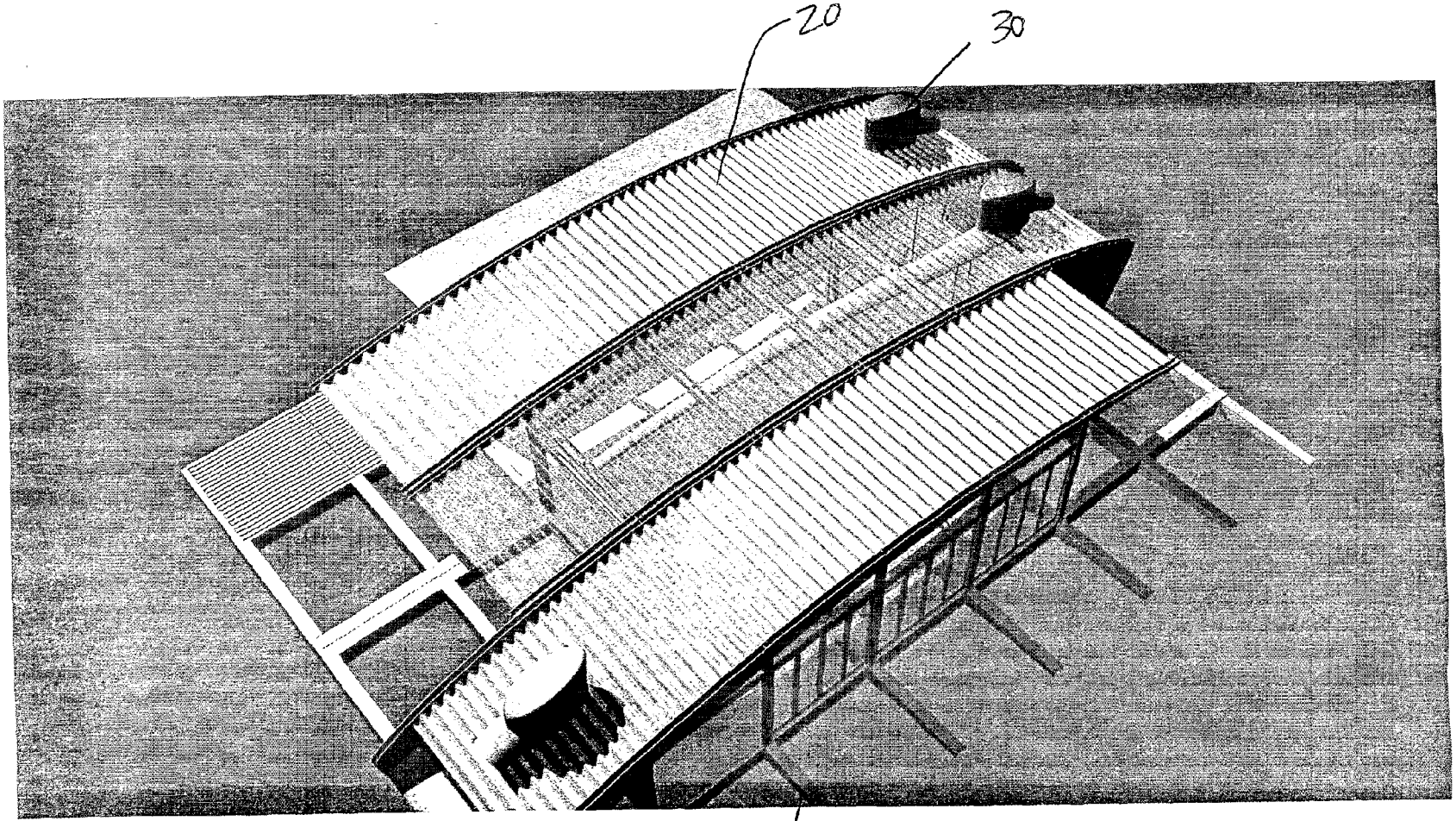
FIG. 23 is top exterior perspective view of another version of the present invention showing three modular rooms and structures that are attached together along their longitudinal sides.
Figure 24:
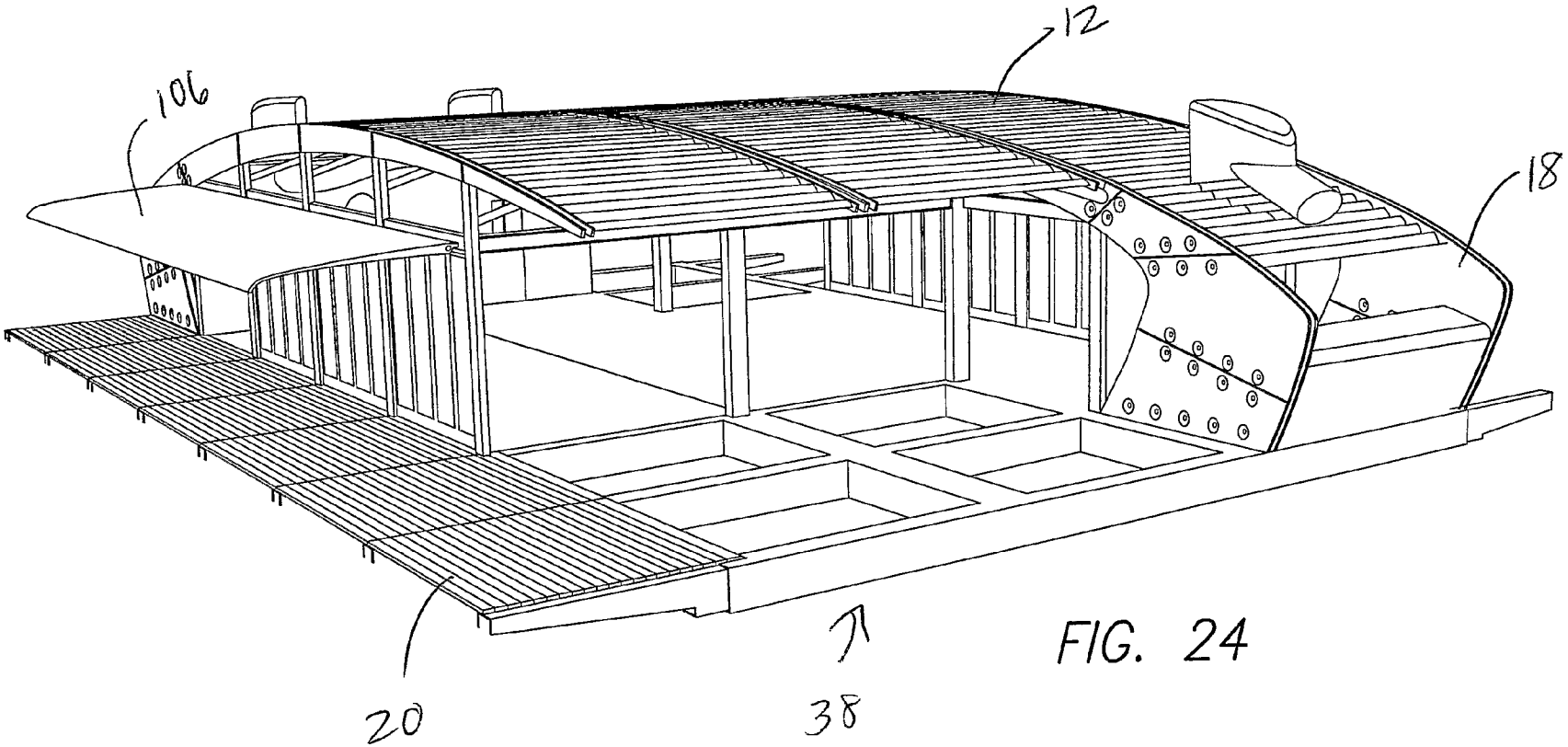
FIG. 24 is a front exterior perspective view of the modular structure shown in FIG. 23.
Figure 25:
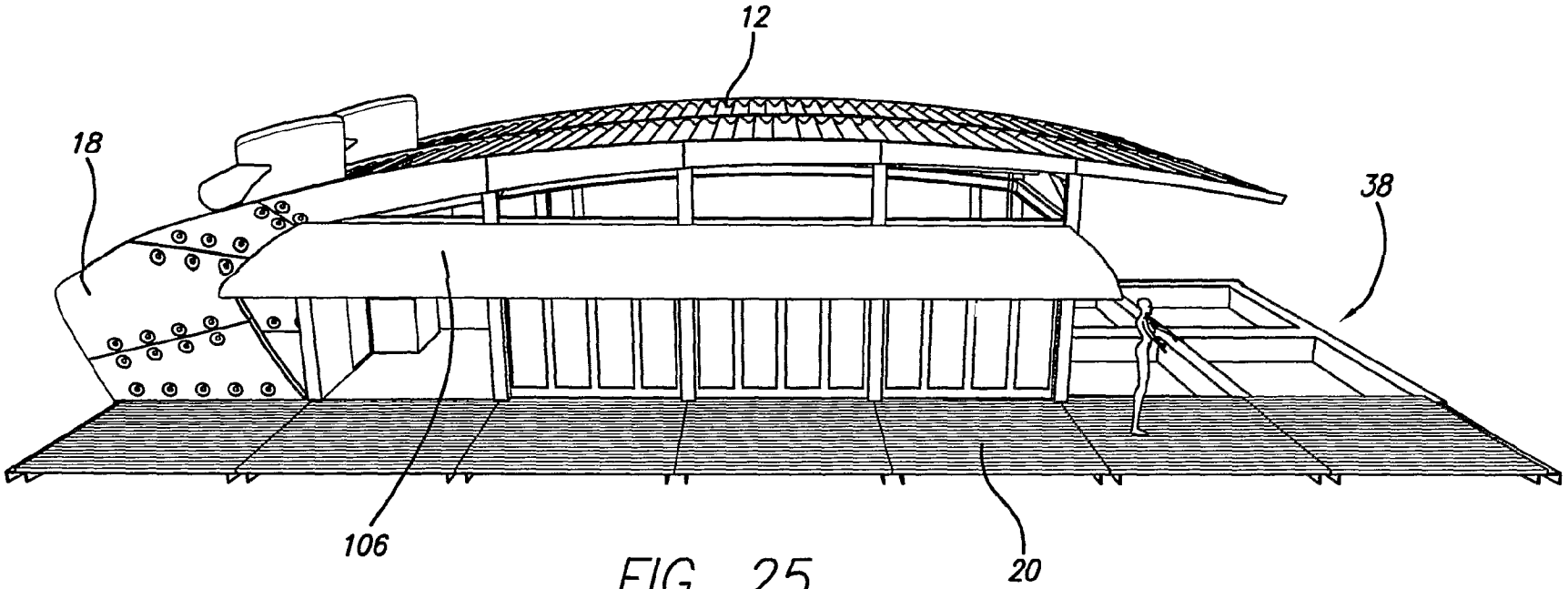
FIG. 25 is a side exterior perspective view of another version of the present invention showing two modular rooms and structures that are attached together along their longitudinal sides.

In a very preferable embodiment it is intended that the modular rooms are connectable with one another at their longitudinal sides and they can be connected parallel or rotated 180° around their vertical axis and/or staggered with one another along the longitudinal axis. It is particularly functional, if adapters 102 (FIG. 20) are provided at the longitudinal sides that serve as partition walls of two connected modular rooms, in order to connect the utility unit of one module with that of another module. When two utility modules are attached side by side, the exterior panels of the utility modules may be removed and replaced with a waterproof sealer element along interior gutters of the modules, and thus the utility units for each module are accessible to the other module. It is understood that the usual well-known materials, in particular materials for lightweight construction such as aluminum, plastic, foam, or fiberglass, are usable for the fabrication of the modular room. FIG. 13 is a perspective view of another version of the modular structure with a deck. FIG. 14 is a top exterior perspective view of another version of the modular structure with a deck and an awning. FIG. 15 is a back exterior view of the modular structure of FIG. 14. FIG. 16 is side exterior view of another version of the present invention showing a modular structure with utility modules at opposite ends to each other. FIG. 17 is a back exterior view of a version of the modular structure of the present invention. FIG. 21 is top exterior perspective view of the modular structure shown in FIG. 20. FIG. 23 is top exterior perspective view of another version of the present invention showing three modular rooms and structures that are attached together along their longitudinal sides. FIG. 24 is a front exterior perspective view of the modular structure shown in FIG. 23. FIG. 25 is a side exterior perspective view of another version of the present invention showing two modular rooms and structures that are attached together along their longitudinal sides.

The high flexibility of modular rooms regarding individual requirements makes it particularly suitable for a broad range of applications. Modular rooms can be used individually or as multiple systems for single family-, multi-family-, row-, vacation homes, duplexes, homes and/or halls for commercial use, for example as conference or meeting facilities, or even as hotel. In addition, the modular room and structure of the present invention may be adapted to include a set of wheels, preferably four wheels, which can be used to aid in transporting the modular room and structure from one location to another. The wheels may be attached to the bottom corners of the modular room and structure. In addition, the modular room and structure of the present invention may be designed for use in areas where hurricanes are prevalent. For example, the modular room and structure may have awnings and decks or verandas, and before a hurricane arrives, the awnings may be lowered against the sides of the structure to protect the windows or side walls, and the decks or verandas may be adapted to be folded upwardly at an angle toward the sides of the structure to facilitate wind resistance.

Although the present invention has been described in considerable detail with reference to certain preferred aspects thereof, other aspects of the invention are possible. Therefore, the scope of the appended claims should not be limited to the description of the preferred aspects contained herein.

What is claimed is:

1. A modular room that can be assembled and disassembled, having a rectangular floor space, a roof, and side walls of skeletal framing construction with sections, the room further comprising:

a foundation with grid-shaped floor plates, which form floor sections or partial sections of the foundation, and a support having a top end that is attached to the roof, and a bottom end which is connected to the foundation, the support spans above the foundation in a substantially arc shape and ends in a free end, wherein the room further comprises wall modules, dividing wall modules, partition wall modules, wall modules with window, door or a combination thereof or roll gates inserted into the skeletal framing construction, wherein the room exhibits floor panels that are attached to the grid-shaped floor plates, and wherein the room is open on three sides.

2. The modular room of claim 1, wherein the rectangular floor space has longitudinal sides that exhibit 2- to 10-times the length of end sides of the floor space.

3. The modular room as of claim 1, wherein the support is connected with the floor plates along longitudinal sides of the floor space.

4. The modular room of claim 1, wherein it exhibits a utility unit on the end at which the support is attached to the foundation.

5. The modular room of claim 4, wherein a home technology, climate control system, heating system, electrical system, water supply, kitchen or a wet area are provided for an area of the utility unit.

6. The modular room of claim 1, wherein two or three side walls consist of skeletal framework construction.

7. The modular room of claim 1, wherein per each room two to four support columns are attached to the foundation.

8. The modular room of claim 1, wherein the support exhibits L-, I- and/or U-shaped sections.

9. The modular room of claim 8, wherein the roof is connected with the support in the area of the L-, I- and/or U-shaped sections.

10. The modular room of claim 1, wherein insulation material is packed between the support and the roof, and in the floor space.

11. The modular room of claim 1, wherein wall modules are attached to the supports on the end which connect the supports of one modular room or two modular rooms with each other.

12. The modular room of claim 1, wherein the floor sections are oblong, rectangular, U-, T- or hollow sections.

13. The floor sections of claim 12, wherein the floor sections can be connected to each other, while a projecting section or U-shaped projecting flanges overlap the outside surfaces of sections with their ends.

14. The modular room of claim 1, wherein it is connectable to another modular room along its longitudinal sides.

15. The modular room of claim 14, wherein the modular rooms can be connected with each other sideways, if they face each other rotated by 180°.

16. The modular room of claim 1, wherein adapters are provided at longitudinal sides that serve as partition walls in order to connect the utility unit of one module with that of another module.

17. The modular room of claim 1, wherein the rectangular floor space, roof, side walls of skeletal framing construction with the floor sections, grid-shaped floor plates, and support are comprised of separate component parts which are no longer than 14 feet in length per component part.

18. A modular structure comprising:

a utility module, and a living module, wherein the utility module comprises a spine portion having a top end and a bottom end and a plurality of utility elements, and wherein the living module comprises a roof portion having a plurality of sides, a floor portion, and side walls made of a skeletal frame construction with sections, such that the top end of the spine portion is attached to the roof portion and the bottom end of the spine portion is attached to the floor portion, wherein the roof is not supported or coupled to a support on three sides, and further wherein the living module exhibits a foundation with grid-shaped floor plates, which form partial sections of the foundation, and further wherein the living module exhibits floor panels that are attached to the grid-shaped floor plates.

19. The modular structure of claim 18, wherein the utility module and living module are comprised of separate component parts which are no longer than 14 feet in length per component part.

* * * * *